US009926060B1

(12) United States Patent
Wiatrowski et al.

(10) Patent No.: US 9,926,060 B1
(45) **Date of Patent: *Mar. 27, 2018**

(54) MARINE OUTBOARD ENGINE HAVING A TILT/TRIM AND STEERING BRACKET ASSEMBLY

(71) Applicant: BRP US INC., Sturtevant, WI (US)

(72) Inventors: Darrell Wiatrowski, Libertyville, IL (US); Mark Whiteside, Zion, IL (US); George Broughton, Wadsworth, IL (US); Mark Noble, Pleasant Prairie, WI (US)

(73) Assignee: BRP US INC., Sturtevant, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/298,667

(22) Filed: Oct. 20, 2016

Related U.S. Application Data

(63) Continuation of application No. 14/606,636, filed on Jan. 27, 2015, now Pat. No. 9,499,247.

(60) Provisional application No. 61/931,981, filed on Jan. 27, 2014.

(51) Int. Cl.

| | |
|---|---|
| ***B63H 20/10*** | (2006.01) |
| ***B63H 20/06*** | (2006.01) |
| ***B63H 20/12*** | (2006.01) |
| ***B63H 5/125*** | (2006.01) |

(52) U.S. Cl.
CPC ..... *B63H 20/10* (2013.01); *B63H 5/125* (2013.01); *B63H 20/06* (2013.01); *B63H 20/12* (2013.01)

(58) Field of Classification Search
CPC ..... B63H 5/125; B63H 20/00; B63H 20/08; B63H 20/10; B63H 20/12; B63H 20/06; B63H 20/14; B63H 5/10; B63H 5/12; B63H 21/26
USPC ..... 440/1, 61 A, 61 R, 61 T
See application file for complete search history.

(56) References Cited

U.S. PATENT DOCUMENTS

| | | | | |
|---|---|---|---|---|
| 4,605,375 | A * | 8/1986 | Ferguson | B63H 20/08 440/1 |
| 6,454,619 | B1 | 9/2002 | Funami et al. | |
| 6,820,567 | B1 | 11/2004 | Kishi et al. | |
| 7,318,386 | B2 | 1/2008 | Dudra et al. | |
| 7,497,183 | B2 | 3/2009 | Dudra et al. | |
| 7,736,206 | B1 | 6/2010 | McChesney et al. | |
| 7,901,258 | B1 * | 3/2011 | McChesney | B63H 20/12 440/1 |
| 8,840,439 | B1 | 9/2014 | Wiatrowski et al. | |
| 8,858,279 | B1 | 10/2014 | Wiatrowski et al. | |

* cited by examiner

*Primary Examiner* — Lars A Olson
(74) *Attorney, Agent, or Firm* — BCF LLP

(57) ABSTRACT

A marine outboard engine for a watercraft has a stern bracket for mounting the marine outboard engine to the watercraft, a swivel bracket pivotally connected to the stern bracket about a generally horizontal tilt/trim axis, and a drive unit pivotally connected to the swivel bracket about a steering axis. The steering axis is generally perpendicular to the tilt/trim axis. A hydraulic actuator is operatively connected to the stern bracket and the swivel bracket for pivoting the swivel bracket and the drive unit relative to the stern bracket about the tilt/trim axis. A pump is mounted to the swivel bracket. The pump is pivotable about the tilt/trim axis together with the swivel bracket. The pump is fluidly connected to the hydraulic actuator to supply hydraulic fluid to the hydraulic actuator.

19 Claims, 30 Drawing Sheets

MARINE OUTBOARD ENGINE HAVING A TILT/TRIM AND STEERING BRACKET ASSEMBLY

CROSS-REFERENCE

The present application is a continuation of U.S. patent application Ser. No. 14/606,636, filed Jan. 27, 2015, which claims priority to U.S. Provisional Patent Application No. 61/931,981, filed Jan. 27, 2014, the entirety of both of which is incorporated herein by reference.

The present application is related to U.S. Pat. No. 8,840,439, issued Sep. 23, 2014, U.S. Pat. No. 8,858,279, issued Oct. 14, 2014, U.S. Provisional Patent Application No. 61/491,561, filed May 31, 2011, and U.S. Provisional Patent Application No. 61/591,429, filed Jan. 27, 2012, the entirety of all of which is incorporated herein by reference.

TECHNICAL FIELD

The present technology relates to tilt/trim and steering bracket assemblies for marine outboard engines.

BACKGROUND

A marine outboard engine generally comprises a bracket assembly that connects the drive unit of the marine outboard engine to the transom of a boat. The drive unit includes the internal combustion engine and propeller. The marine outboard engine is typically designed so that the steering angle and the tilt/trim angles of the drive unit relative to the boat can be adjusted and modified as desired. The bracket assembly typically includes a swivel bracket carrying the drive unit for pivotal movement about a steering axis and a stern bracket supporting the swivel bracket and the drive unit for pivotal movement about a tilt axis extending generally horizontally. The stern bracket is connected to the transom of the boat.

Some marine outboard engines are provided with a hydraulic linear actuator connected between the stern and swivel brackets for pivoting the swivel bracket to lift the lower portion of the outboard engine above the water level or, conversely, lower the lower portion of the outboard engine below the water level. Some marine outboard engines are also provided with a distinct hydraulic linear actuator for pivoting the swivel bracket through a smaller range of angles and at slower rate of motion to trim the outboard engine while the lower portion thereof is being submerged. Some marine outboard engines are also provided with a hydraulic linear actuator connected between the swivel bracket and the drive unit for pivoting the drive unit about the steering axis in order to steer the boat.

In order to operate the one or more hydraulic actuators, hydraulic fluid needs to be supplied to the actuators, which requires one or more pumps, hydraulic fluid reservoirs, and multiple valves and hoses. Due to the fairly complex and bulky mechanical structure of the bracket assembly provided with the hydraulic actuators, the pumps and reservoirs are typically provided inside the boat. This can take up valuable space inside the boat and requires the routing of hoses between the pumps and actuators which can be cumbersome. Furthermore, the installation of the pumps and the connection of the pumps and hoses with the reservoirs, valves, and actuators can be time consuming and can lead to hoses being improperly connected or connected to the wrong component. For example, the hoses to be connected to each end of the hydraulic actuator used for steering, if connected backwards, lead to the boat being steered in the direction opposite to the intended direction.

SUMMARY

It is an object of the present technology to ameliorate at least some of the inconveniences present in the prior art.

In one aspect, implementations of the present technology provide a marine outboard engine for a watercraft having a stern bracket for mounting the marine outboard engine to the watercraft, a swivel bracket pivotally connected to the stern bracket about a generally horizontal tilt/trim axis, a drive unit pivotally connected to the swivel bracket about a steering axis, the steering axis being generally perpendicular to the tilt/trim axis, a hydraulic actuator operatively connected to the drive unit and the swivel bracket for pivoting the drive unit relative to the swivel bracket about the steering axis, and a pump mounted to the swivel bracket. The pump is pivotable about the tilt/trim axis together with the swivel bracket. The pump is fluidly connected to the hydraulic actuator to supply hydraulic fluid to the hydraulic actuator.

In some implementations of the present technology, the pump is a first pump and the hydraulic actuator is a first hydraulic actuator. The marine outboard engine also has a second hydraulic actuator operatively connected to the stern bracket and the swivel bracket for pivoting the swivel bracket and the drive unit relative to the stern bracket about the tilt/trim axis, and a second pump mounted to the swivel bracket. The second pump is pivotable about the tilt/trim axis together with the swivel bracket. The second pump is fluidly connected to the second hydraulic actuator to supply hydraulic fluid to the second hydraulic actuator.

In some implementations of the present technology, the first pump is disposed between the tilt/trim axis and the second pump.

In some implementations of the present technology, the first hydraulic actuator has first and second ports. The first pump supplies hydraulic fluid to the first port to pivot the drive unit in a first direction about the steering axis. The first pump supplies hydraulic fluid to the second port to pivot the drive unit in a second direction about the steering axis. The marine outboard engine also has a valve unit containing at least one valve. A position of the at least one valve determines the one of the first and second ports that is supplied with hydraulic fluid from the first pump. The valve unit is mounted to the swivel bracket. The first pump is mounted to the valve unit. The valve unit defines a fluid reservoir for containing hydraulic fluid. The reservoir is fluidly connected to the second pump.

In some implementations of the present technology, the first and second hydraulic actuators are first and second rotary hydraulic actuators.

In some implementations of the present technology, the marine outboard engine also has a third hydraulic actuator. The third hydraulic actuator is a linear hydraulic actuator mounted to the swivel bracket between the swivel bracket and the stern bracket. The second pump is fluidly connected to the linear hydraulic actuator to supply hydraulic fluid to the linear hydraulic actuator. The linear hydraulic actuator is adapted to push the swivel bracket away from the stern bracket to pivot the swivel bracket and the drive unit away from the stern bracket about the tilt/trim axis up to a first angle. The second hydraulic actuator is adapted to pivot the swivel bracket and the drive unit relative to the stern bracket about the tilt/trim axis up to a second angle. The second angle is greater than the first angle.

In some implementations of the present technology, the first pump is disposed between the tilt/trim axis and the linear hydraulic actuator.

In some implementations of the present technology, the hydraulic actuator has first and second ports. The pump supplies hydraulic fluid to the first port to pivot the drive unit in a first direction about the steering axis. The pump supplies hydraulic fluid to the second port to pivot the drive unit in a second direction about the steering axis. The marine outboard engine also has a valve unit containing at least one valve. A position of the at least one valve determines the one of the first and second ports that is supplied with hydraulic fluid from the pump. The valve unit is mounted to the swivel bracket. The pump is mounted to the valve unit.

In some implementations of the present technology, the at least one valve has a third port, a fourth port, and a fifth port. The pump is fluidly connected to the third port and supplies hydraulic fluid to the third port. The fourth port is fluidly connected to the first port. The fifth port is fluidly connected to the second port. In a first position of the at least one valve, the third port is fluidly connected to the fourth port, the third port is fluidly disconnected from the fifth port and the pump supplies hydraulic fluid to the first port via the at least one valve. In a second position of the at least one valve, the third port is fluidly connected to the fifth port, the third port is fluidly disconnected from the fourth port and the pump supplies hydraulic fluid to the second port via the at least one valve.

In some implementations of the present technology, the pump is an electric pump. The valve unit includes at least one pressure sensor sensing hydraulic pressure of hydraulic fluid in the valve unit. The marine outboard engine also has a control module communicating with the pump to control operation of the pump. The control module controls the pump based at least in part on a signal from the at least one pressure sensor.

In some implementations of the present technology, the drive unit includes the control module.

In some implementations of the present technology, the hydraulic actuator is a first hydraulic actuator. The pump is adapted to receive hydraulic fluid from a second hydraulic actuator via the valve unit, the second hydraulic actuator being driven by a helm of the watercraft. The pump supplies the hydraulic fluid received from the second hydraulic actuator via the valve unit to the first hydraulic actuator. The at least one pressure sensor includes a first pressure sensor and a second pressure sensor. One of the first and second pressure sensors senses a hydraulic pressure of hydraulic fluid flowing from the second hydraulic actuator to the valve unit. Another one of the first and second pressure sensors senses a hydraulic pressure of hydraulic fluid flowing from the valve unit to the second hydraulic actuator. The control module causes the pump to operate when a difference between the hydraulic pressure sensed by the first pressure sensor and the hydraulic pressure sensed by the second pressure sensor is above a predetermined value. The control module causes the pump to stop operating when the difference between the hydraulic pressure sensed by the first pressure sensor and the hydraulic pressure sensed by the second pressure sensor is below the predetermined value.

In some implementations of the present technology, the hydraulic actuator is a first hydraulic actuator. The pump is adapted to receive hydraulic fluid from a second hydraulic actuator. The second hydraulic actuator is driven by a helm of the watercraft. The pump supplies the hydraulic fluid received from the second hydraulic actuator to the first hydraulic actuator. The valve unit includes a low pressure bypass valve. The valve unit causes hydraulic fluid received from the second hydraulic actuator to bypass the pump when a pressure of the hydraulic fluid received from the second hydraulic actuator is below a predetermined pressure.

In some implementations of the present technology, the pump includes a shaft. The shaft is rotatable about a pump axis. The pump axis is generally parallel to the tilt/trim axis and generally perpendicular to the steering axis.

In some implementations of the present technology, a plurality of passages fluidly connecting the pump to the hydraulic actuator. At least a portion of the plurality of passages is integrally formed in the swivel bracket.

In some implementations of the present technology, the pump is disposed between the tilt/trim axis and a lower end of the swivel bracket.

In some implementations of the present technology, the drive unit is disposed on a first side of the swivel bracket. The stern bracket and the pump are disposed on a second side of the swivel bracket. The second side is opposite the first side.

In some implementations of the present technology, an upper drive unit mounting bracket connects the drive unit to a first end of the hydraulic actuator. A lower drive unit mounting bracket connects the drive unit to a second end of the hydraulic actuator. The pump is disposed between the upper and lower drive unit mounting brackets.

In some implementations of the present technology, the hydraulic actuator is a first hydraulic actuator. The pump is adapted to receive hydraulic fluid from a second hydraulic actuator. The second hydraulic actuator is driven by a helm of the watercraft. The pump supplies the hydraulic fluid received from the second hydraulic actuator to the first hydraulic actuator.

In some implementations of the present technology, the stern bracket defines a space between a left portion of the stern bracket and a right portion of the stern bracket. The pump is received at least in part in the space when the swivel bracket is in an upright position.

For purposes of this application, the term related to spatial orientation such as forward, rearward, left, right, vertical, and horizontal are as they would normally be understood by a driver of a boat sitting thereon in a normal driving position with a marine outboard engine mounted to a transom of the boat.

Implementations of the present technology each have at least one of the above-mentioned aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects, and advantages of implementations of the present technology will become apparent from the following description, the accompanying drawings, and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

Figure 1:
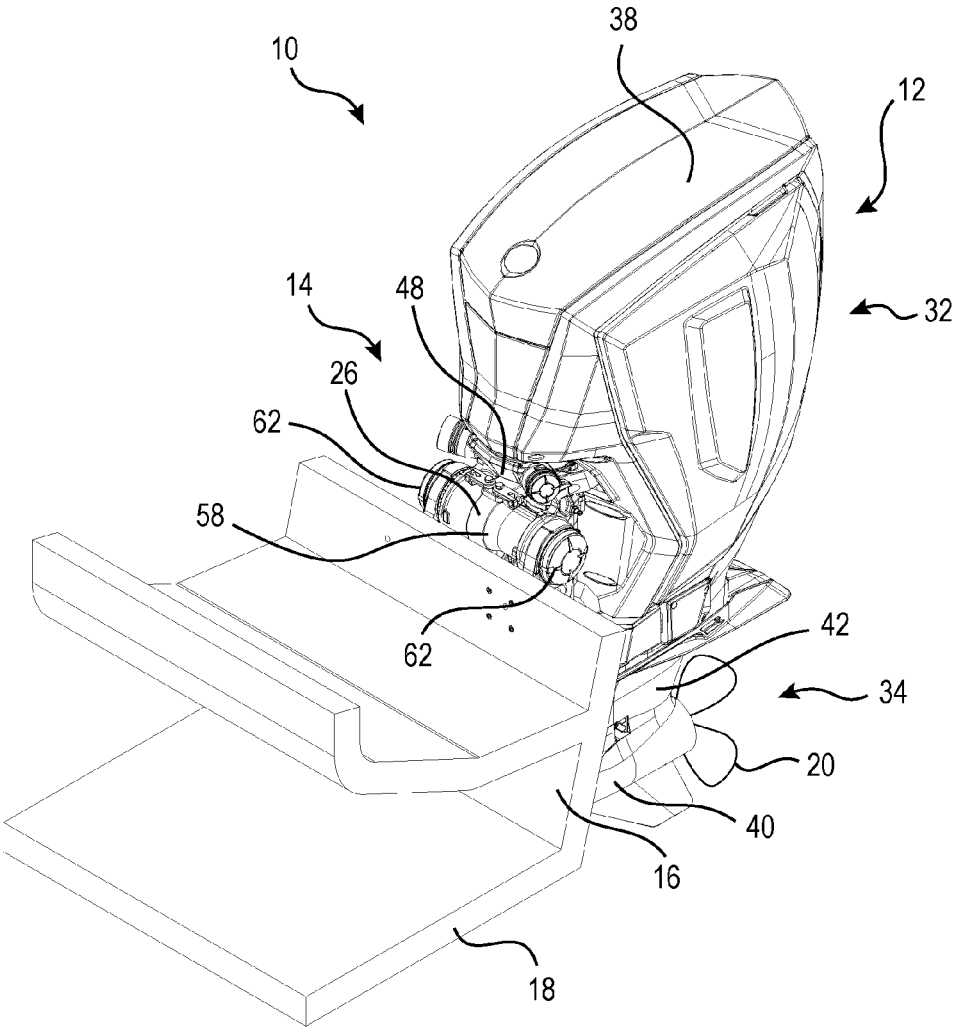
FIG. 1 is a perspective view taken from a front, left side of a marine outboard engine mounted in an upright position to a transom of watercraft.
Figure 2:
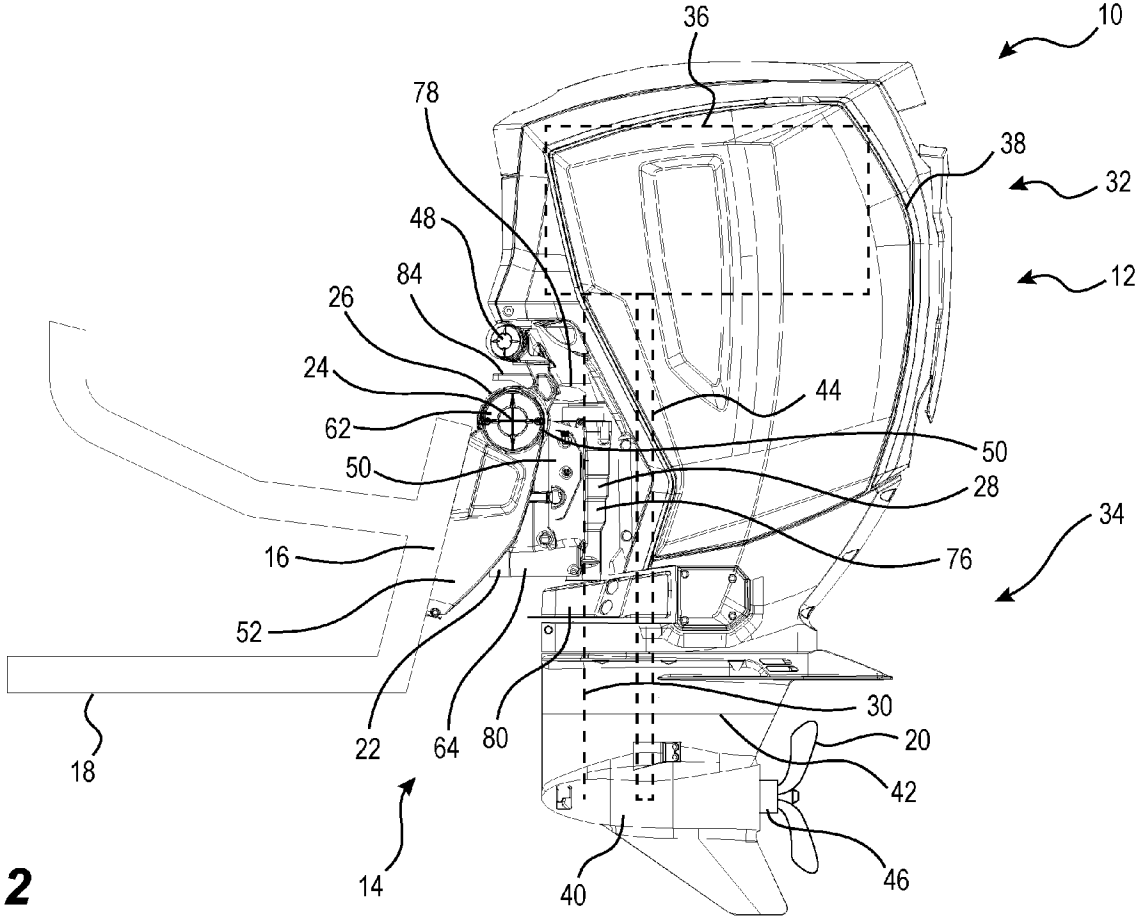
FIG. 2 is a left side elevation view of the outboard engine of FIG. 1.
Figure 3:
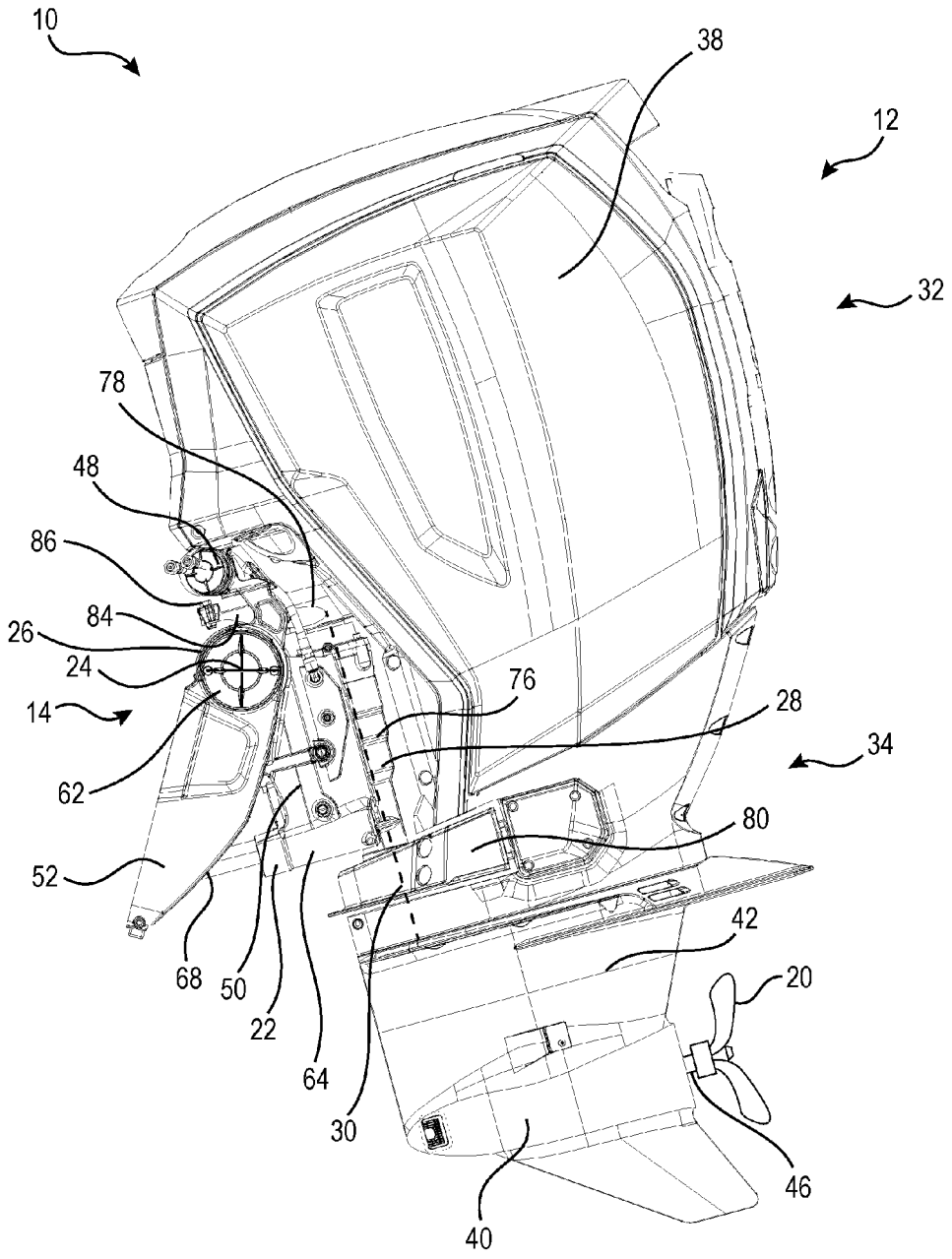
FIG. 3 is a left side elevation view of the outboard engine of FIG. 1 in a trim up position.

With reference to FIGS. 1 and 2, a marine outboard engine 10, shown in the upright position, includes a drive unit 12 and a bracket assembly 14. The bracket assembly 14 supports the drive unit 12 on a transom 16 of a hull 18 of an associated watercraft (not shown) such that a propeller 20 is in a submerged position with the watercraft resting relative to a surface of a body of water. The drive unit 12 can be trimmed up (see FIG. 3) or down relative to the hull 18 by linear actuators 22 of the bracket assembly 14 about a tilt/trim axis 24 extending generally horizontally. The drive unit 12 can also be tilted up (see FIG. 4) or down relative to the hull 18 by a rotary actuator 26 of the bracket assembly 14 about the tilt/trim axis 24. The drive unit 12 can also be steered left (see FIG. 6) or right relative to the hull 18 by another rotary actuator 28 of the bracket assembly 14 about a steering axis 30. The steering axis 30 extends generally perpendicularly to the tilt/trim axis 24. When the drive unit 12 is in the upright position as shown in FIGS. 1 and 2, the steering axis 30 extends generally vertically. The actuators 22, 26 and 28 are hydraulic actuators. The actuators 22, 26 and 28 and their operation will be discussed in greater detail below.

The drive unit 12 includes an upper portion 32 and a lower portion 34. The upper portion 32 includes an engine 36 (schematically shown in dotted lines in FIG. 2) surrounded and protected by a cowling 38. The engine 36 housed within the cowling 38 is an internal combustion engine, such as a two-stroke or four-stroke engine, having cylinders extending horizontally. It is contemplated that other types of engine could be used and that the cylinders could be oriented differently. The lower portion 34 includes the gear case assembly 40, which includes the propeller 20, and the skeg portion 42, which extends from the upper portion 32 to the gear case assembly 40.

The engine 36 is coupled to a driveshaft 44 (schematically shown in dotted lines in FIG. 2). When the drive unit 12 is in the upright position as shown in FIG. 2, the driveshaft 44 is oriented vertically. It is contemplated that the driveshaft 44 could be oriented differently relative to the engine 34. The driveshaft 44 is coupled to a drive mechanism (not shown), which includes a transmission (not shown) and the propeller 20 mounted on a propeller shaft 46. In FIG. 2, the propeller shaft 46 is perpendicular to the driveshaft 44, however it is contemplated that it could be at other angles. The driveshaft 44 and the drive mechanism transfer the power of the engine 36 to the propeller 20 mounted on the rear side of the gear case assembly 40 of the drive unit 12. It is contemplated that the propulsion system of the outboard engine 10 could alternatively include a jet propulsion device, turbine or other known propelling device. It is further contemplated that the bladed rotor could alternatively be an impeller.

To facilitate the installation of the outboard engine 10 on the watercraft, the outboard engine 10 is provided with a box 48. The box 48 is connected on top of the rotary actuator 26. As a result, the box 48 pivots about the tilt/trim axis 24 when the outboard engine 10 is tilted, but does not pivot about the steering axis 30 when the outboard engine 10 is steered. It is contemplated that the box 48 could be mounted elsewhere on the bracket assembly 14 or on the drive unit 12. Devices located inside the cowling 38 which need to be connected to other devices disposed externally of the outboard engine 10, such as on the deck or hull 18 of the watercraft, are provided with lines which extend inside the box 48. In one implementation, these lines are installed in and routed to the box 48 by the manufacturer of the outboard engine 10 during manufacturing of the outboard engine 10. Similarly, the corresponding devices disposed externally of the outboard engine 10 are also provided with lines that extend inside the box 48 where they are connected with their corresponding lines from the outboard engine 10. It is contemplated that one or more lines could be connected between one or more devices located inside the cowling 38 to one or more devices located externally of the outboard engine 10 and simply pass through the box 48. In such an implementation, the box 48 would reduce movement of the one or more lines when the outboard engine 10 is steered, tilted or trimmed.

Other known components of an engine assembly are included within the cowling 38, such as a starter motor, an alternator and the exhaust system. As it is believed that these components would be readily recognized by one of ordinary skill in the art, further explanation and description of these components will not be provided herein.

Turning now to FIGS. 7 to 17, the bracket assembly 14 will be described in more detail. The bracket assembly 14 includes a swivel bracket 50 pivotally connected to a stern bracket 52 via the rotary actuator 26. The stern bracket 52 includes a plurality of holes 54 and slots 56 adapted to receive fasteners (not shown) used to fasten the bracket assembly 14 to the transom 16 of the watercraft. By providing many holes 54 and slots 56, the vertical position of the stern bracket 52, and therefore the bracket assembly 14, relative to the transom 16 can be adjusted.

The rotary actuator 26 includes a cylindrical main body 58, a central shaft (not shown) disposed inside the main body 58 and protruding from the ends thereof, and a piston (not shown) surrounding the central shaft and disposed inside the main body 58. The main body 58 is located at an upper end of the swivel bracket 50 and is integrally formed therewith. It is contemplated that the main body 58 could be fastened, welded, or otherwise connected to the swivel bracket 50. The central shaft is coaxial with the tilt/trim axis 24. Splined disks 60 (FIG. 9) are provided over the portions of the central shaft that protrude from the main body 58. The splined disks 60 are connected to the central shaft so as to be rotationally fixed relative to the central shaft. The stern bracket 52 has splined openings at the upper end thereof that receive the splined disks 60 therein. As a result, the stern bracket 52, the splined disks 60 and the central shaft are all rotationally fixed relative to each other. Anchoring end portions 62 are fastened to the sides of the stern bracket 52 over the splined openings thereof and the ends of the central shaft, thus preventing lateral displacement of the swivel bracket 50 relative to the stern bracket 52.

The piston is engaged to the central shaft via oblique spline teeth on the central shaft and matching splines on the inside diameter of the piston. The piston is slidably engaged to the inside wall of the cylindrical main body 58 via longitudinal splined teeth on the outer diameter of the piston and matching splines on the inside diameter of the main body 58. By applying pressure on the piston, by supplying hydraulic fluid inside the main body 58 on one side of the piston, the piston slides along the central shaft. Since the central shaft is rotationally fixed relative to the stern bracket 52, the oblique spline teeth cause the piston, and therefore the main body 58 (due to the longitudinal spline teeth), to pivot about the central shaft and the tilt/trim axis 24. The connection between the main body 58 and the swivel bracket 50 causes the swivel bracket 50 to pivot about the tilt/trim axis 24 together with the main body 58. Supplying hydraulic fluid to one side of the piston causes the swivel bracket 50 to pivot away from the stern bracket 52 (i.e. tilt up). Supplying hydraulic fluid to the other side of the piston causes the swivel bracket 50 to pivot toward the stern bracket 52 (i.e. tilt down). In the present implementation, supplying hydraulic fluid to the left side of the piston causes the swivel bracket 50 to tilt up and supplying hydraulic fluid to the ride side of the piston causes the swivel bracket 50 to tilt down.

U.S. Pat. No. 7,736,206 B1, issued Jun. 15, 2010, the entirety of which is incorporated herein by reference, provides additional details regarding rotary actuators similar in construction to the rotary actuator 26. It is contemplated that the rotary actuator 26 could be replaced by a linear hydraulic actuator connected between the swivel bracket 50 and the stern bracket 52.

To maintain the swivel bracket 50 in a half-tilt position (i.e. a position intermediate the positions shown in FIGS. 2 and 4), which is a position of the swivel bracket 50 typically used when the watercraft is in storage or on a trailer, the bracket assembly 14 is provided with a locking arm 63 pivotally connected to the swivel bracket 50. To use the locking arm 63, the swivel bracket 50 is tilted up slightly past the half-tilt position, the locking arm 63 is pivoted to its locking position, and the swivel bracket 50 is tilted down to the half-tilt position where the locking arm 63 makes contact with the stern bracket 52. The locking arm 63 thus alleviates stress on the rotary actuator 26 and its associated hydraulic components during storage or transport on a trailer.

Figure 9:
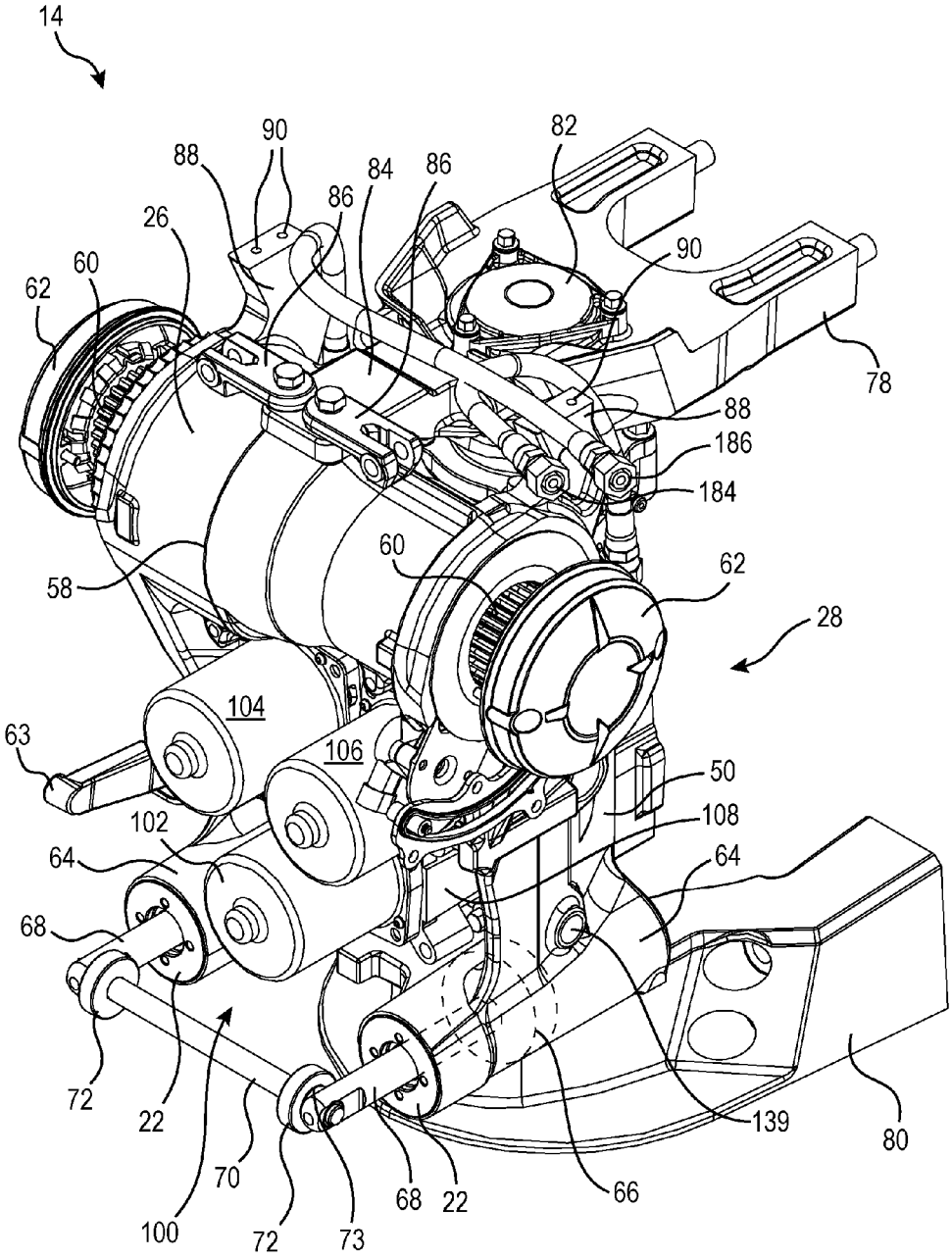
FIG. 9 is a perspective view taken from a front, left side of the bracket assembly of FIG. 7 with the stern bracket removed.

As best seen in FIG. 9, the linear actuators 22 each include a cylinder 64, a piston 66 (only the left piston 66 is shown in dotted lines in FIG. 9) disposed inside the cylinder 64, and a rod 68 connected to the piston 66 and protruding from the cylinder 64. As can be seen, the cylinders 64 are located at a lower end of the swivel bracket 50. The cylinders 64 are integrally formed with the swivel bracket 50 and the lines which supply them with hydraulic fluid are formed thereby, as will be discussed in further detail below. It is contemplated that the cylinders 64 could alternatively be fastened, welded, or otherwise connected to the swivel bracket 50. The rods 68 extend generally perpendicularly to the tilt/trim axis 24 and to the steering axis 30. It is contemplated that the hydraulic linear actuators 22 could be replaced by other types of linear actuators having a fixed portion connected to the swivel bracket 50 and a movable portion being extendable and retractable linearly relative to the fixed portion.

Figure 10:
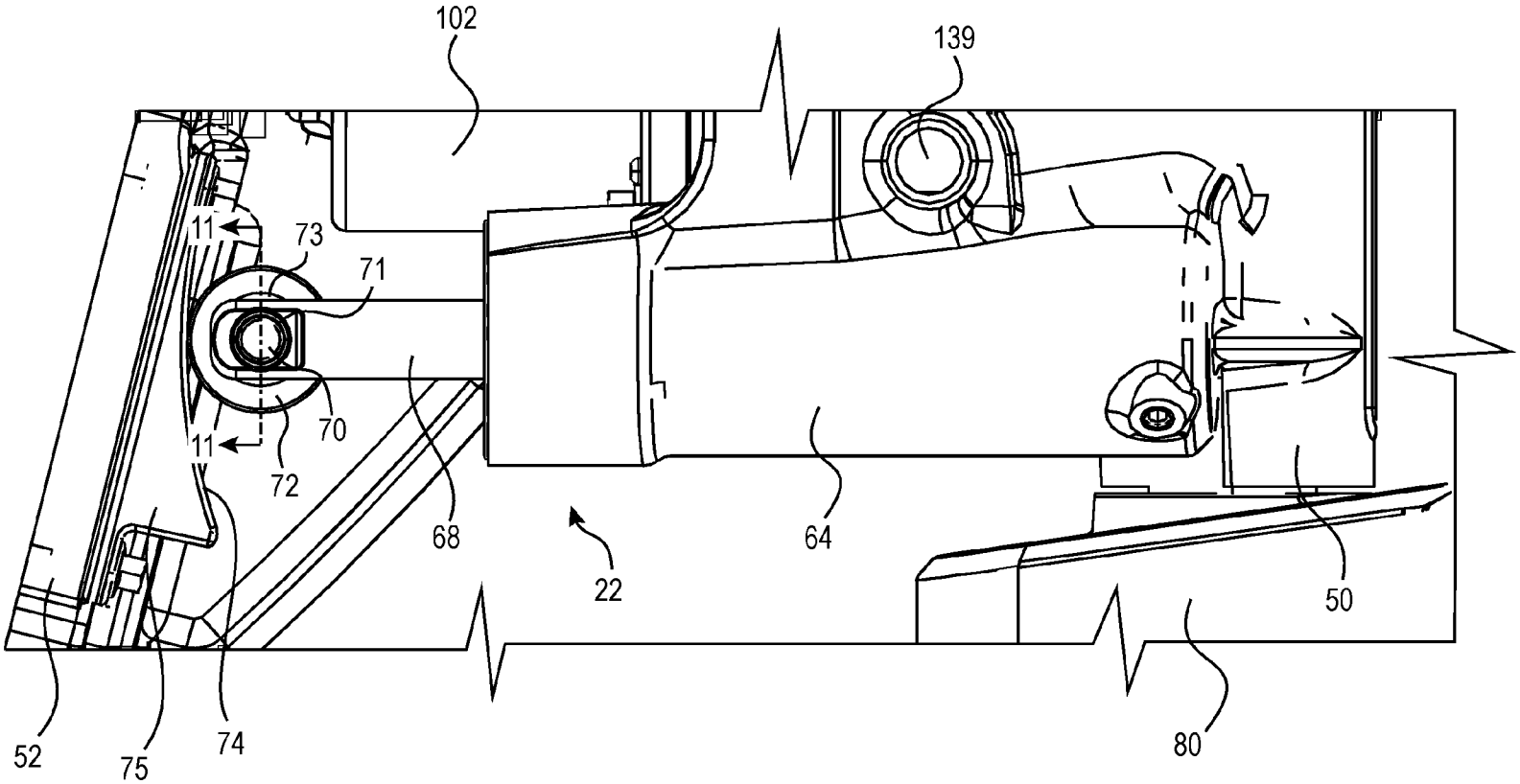
FIG. 10 is a close-up, left side elevation view of a left linear actuator and a corresponding ramp of the bracket assembly of FIG. 7
Figure 11:
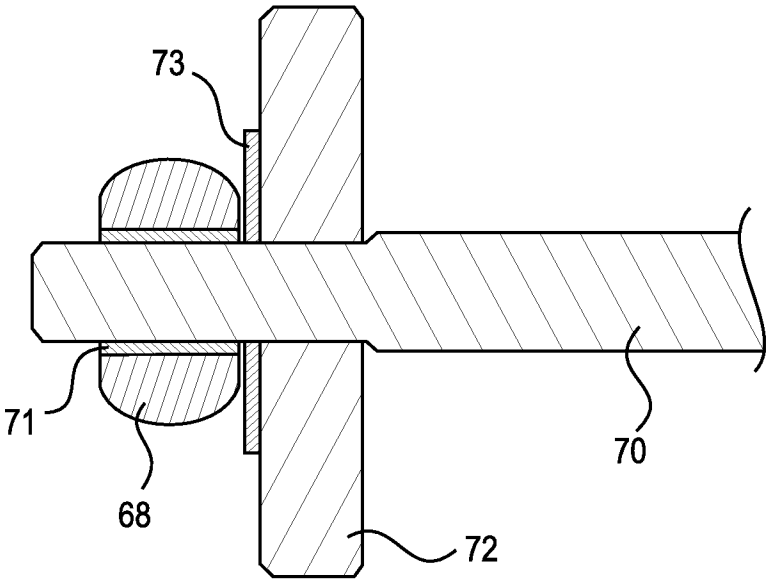
FIG. 11 is a cross-sectional view of the end of the linear actuator of FIG. 10 taken through line 11-11 of FIG. 10.

A shaft 70 with rollers 72 thereon extends from one rod 68 to the other. The rollers 72 are made of stainless steel, but other materials, such as plastics, are contemplated. As best seen in FIGS. 9 to 11, the ends of the shaft 70 are inserted inside apertures in the end portions of the rods 68. A bushing 71 is inserted inside each aperture between each end of the shaft 70 and its corresponding rod 68 as can be seen in FIG. 11 for the left end of the rod. The bushings 71 act as journal bearings to allow the rod 70 to rotate inside the apertures of the rods 68. It is contemplated that the bushings 71 could be replaced by bearings, such as ball bearings for example. It is also contemplated that the bushings 71 could be omitted. The rollers 72 are press-fit onto the shaft 70. As a result, both rollers 72 and the shaft 70 rotate together. It is contemplated that the rollers 72 could be rotationally fixed to the shaft 70 by other types of connections. For example, the rollers 72 could be welded, fastened or splined onto the shaft 70. In an alternative implementation, the shaft 70 is rotationally fixed relative to the rods 68 by being welded, fastened or otherwise connected thereto, and the rollers 72 are rotationally mounted onto the shaft 70 with bearings or bushings for example. As can be seen, the rollers 72 are disposed laterally inwardly of the rods 68. In other words, the left roller 72 is disposed to the right of the left rod 68 and the right roller 72 is disposed to the left of the right rod 68. It is contemplated that the rollers 72 could be disposed laterally outwardly of the rods 68. It is also contemplated that the ends of the rods 68 could be forked and that the rollers 72 could be received in the forked ends of the rods 68. As can be seen in FIG. 11 for the left end portion of the shaft 70, in the present implementation, the diameter of the shaft 70 where each roller 72 is press-fit is smaller than the diameter of the central portion of the shaft 70 and is greater than the diameter of the ends of the shaft 70. It is contemplated that the shaft 70 could have a uniform diameter. It is also contemplated that the shaft 70 could have diameters different from the ones illustrated. For example, the diameter of the shaft 70 where each roller 72 is press-fit could be the greatest diameter of the shaft 70. Each roller 72 is disposed in proximity to its corresponding rod 68 to reduce lateral movement of the rod 70. A washer 73 is disposed on the shaft 70 between each roller 72 and the side of its corresponding rod 68.

Figure 4:
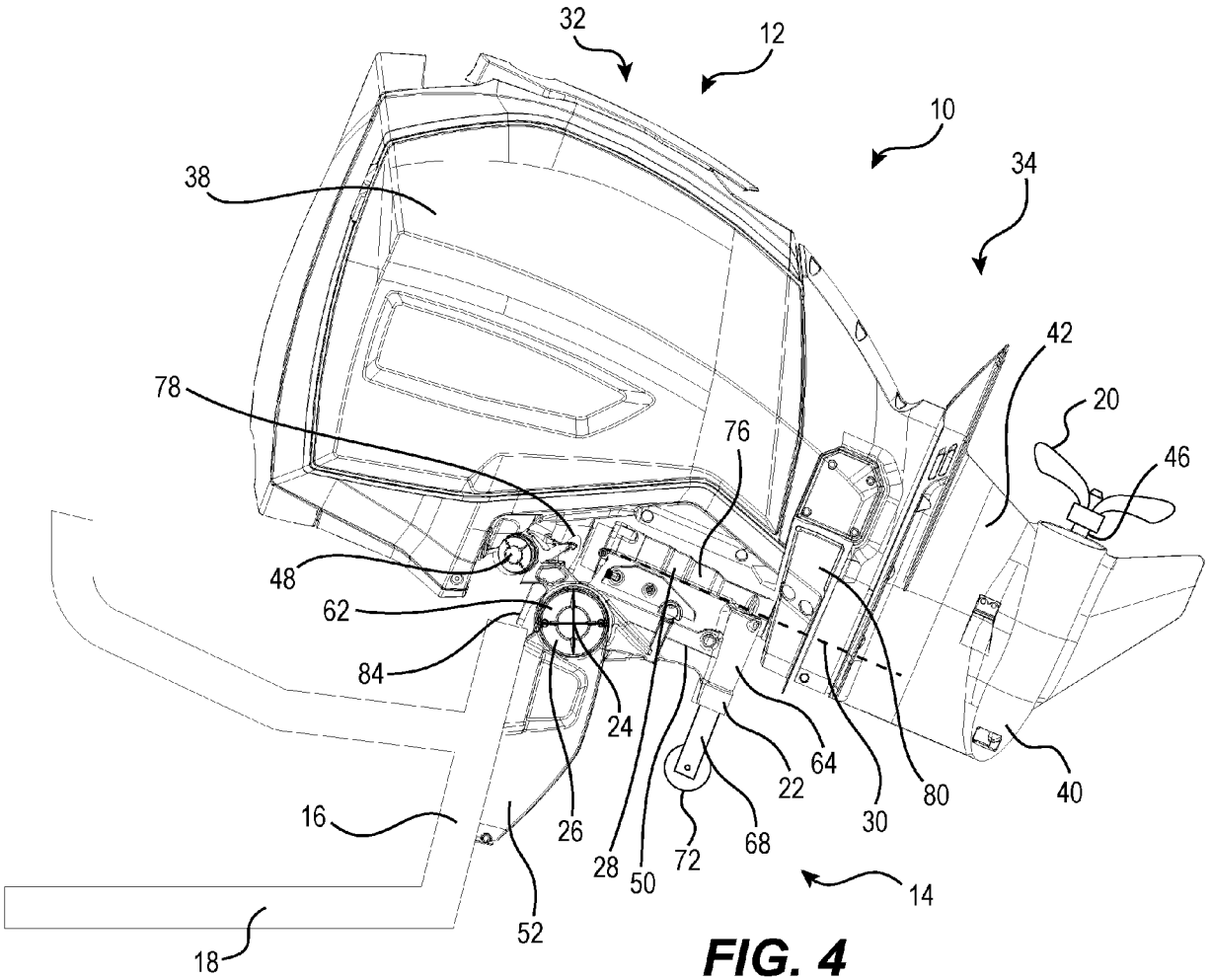
FIG. 4 is a left side elevation view of the outboard engine of FIG. 1 in a tilt up position.
Figure 5:
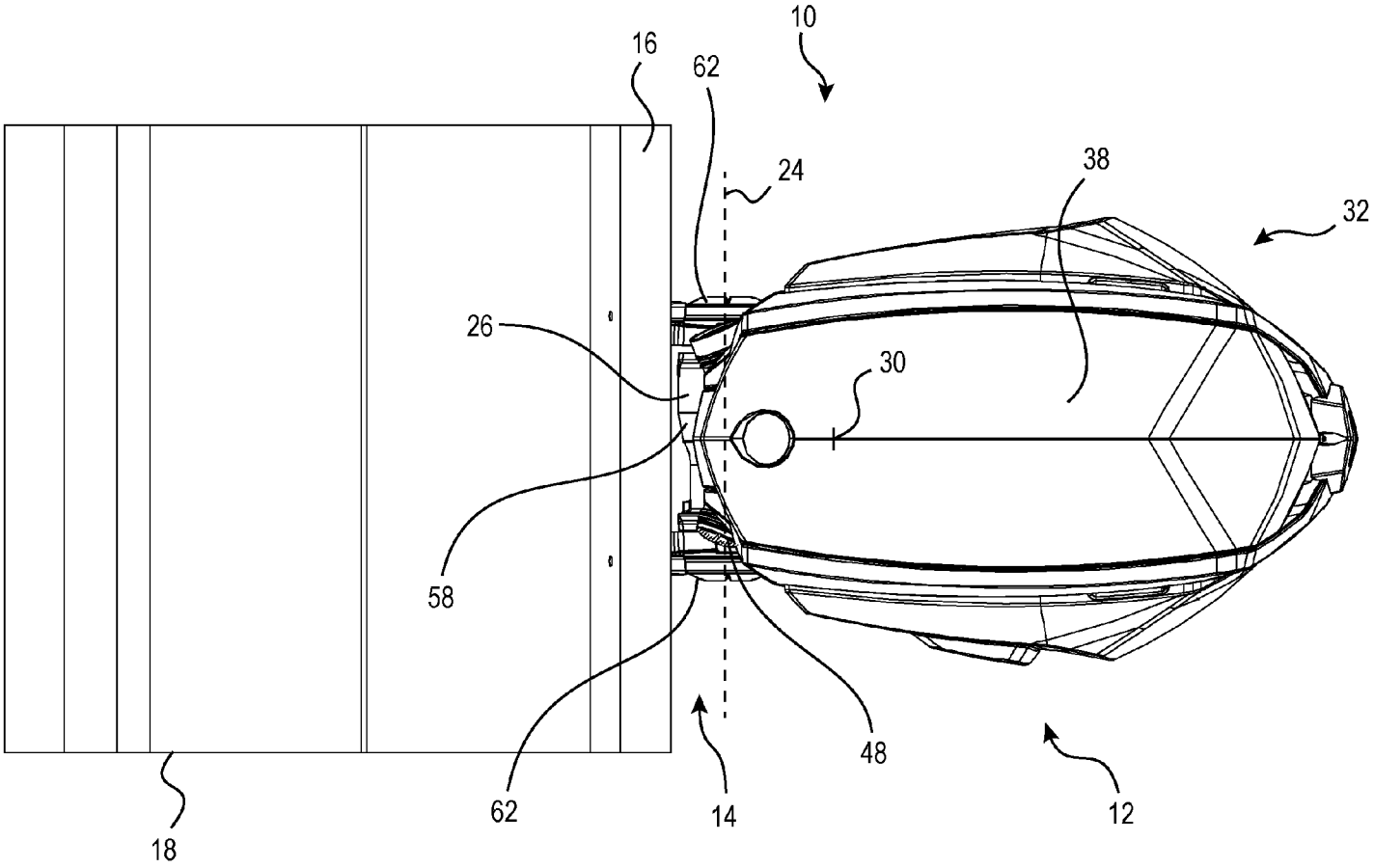
FIG. 5 is a top plan view of the outboard engine of FIG. 1 steered in a straight ahead direction.

By supplying hydraulic fluid inside the cylinders 64 on the side of the pistons 66 opposite the side from which the rods 68 extend, the pistons 66 slide inside the cylinders 64. This causes the rods 68 to extend further from the cylinders 64 and the rollers 72 to roll along and push against the curved surfaces 74 formed by the ramps 75 connected to the stern bracket 52. The shaft 70 helps maintain the rollers 72 in alignment with each other. It is also contemplated that the alignment of the rollers 72 could be maintained in another manner. For example, it is contemplated that the complementary shapes of the pistons 66 and the cylinders 64, or alternatively of the rods 68 and the cylinders 66, could maintain the alignment of the rollers 72. The ramps 75 are fastened to the back of the stern bracket 52. It is contemplated that the ramps 75 could be welded to the stern bracket 52, integrally formed with the stern bracket 52, or otherwise connected to the stern bracket 52. As the rods 68 extend from their respective cylinders 64, the rollers 72 roll down along the curved surfaces 74. As the rollers 72 roll down along the curved surfaces 74, they move away from the stern bracket 52 due to the profile of the surfaces 74. As a result of the rods 68 extending from the cylinders 64 and the rollers 72 rolling along the surfaces 74, the swivel bracket 50 pivots away from the stern bracket 52 (i.e. trims up) about the tilt/trim axis 24 up to the angle shown in FIG. 3 where the rods 68 are fully extended. The profile of the curved surfaces 74 determines the speed at which the swivel bracket 50 pivots about the tilt/trim axis 24 (trim speed) for a given amount of extension of the rods 68. In one implementation, the profile of the curved surfaces 74 is selected such that the rods 68 remain perpendicular to their corresponding surfaces 74 at the points of contact at all times. This can reduce side loading on the rods 68 during operation. In addition, such a curved surface 74 ensures that the trim speed remains constant for a constant rate of extension of the rods 68. In other words, each inch of travel of the rods 68 results in the same amount of rotation of the swivel bracket 50 about the tilt/trim axis 24 throughout the stroke. In another implementation, the profile of the curved surfaces 74 is selected such that the trim speed increases as the rods 68 extend for a constant rate of extension of the rods 68, thus providing a smoother transition in angular speed from trim to tilt. In one exemplary implementation, the curved surfaces 74 each define an arc having a center of curvature disposed generally at a center of a surface of their corresponding pistons 66 facing away from the stern bracket 52. It is contemplated that the curved surfaces 74 could be replaced with straight surfaces angled relative to the surface to which the ramps 75 connect of the stern bracket 52. In one exemplary implementation, the swivel bracket 50 pivots by 22 degrees from its lowest position to the highest trim position shown in FIG. 3. It is contemplated that this angle could be between 15 and 30 degrees. Once this angle is reached, should further pivoting of the swivel bracket 50 relative to the stern bracket 52 (i.e. tilt) be desired, the rotary actuator 26 provides the pivoting motion up to the angle shown in FIG. 4. As can be seen in FIG. 4, the rollers 72 no longer make contact with the stern bracket 52. To pivot the swivel bracket 50 back toward the stern bracket 52 (i.e. trim down) about the tilt/trim axis 24 from the position shown in FIG. 3, the hydraulic fluid can be actively removed from the cylinders 64 (i.e. pumped out), or can be pushed out of the cylinders 64 by the pistons 66 due to the weight of the swivel bracket 50 and the drive unit 12 pushing toward the stern bracket 52. The movement achieved by the linear actuators 22 is known as trim as they allow for precise angular adjustment of the swivel bracket 50 relative to the stern bracket 52 at a slower angular speed than that provided by the rotary actuator 26.

Similarly to the rotary actuator 26, the rotary actuator 28 includes a cylindrical main body 76, a central shaft (not shown) disposed inside the main body 76 and protruding from the ends thereof and a piston (not shown) surrounding the central shaft and disposed inside the main body 76. The main body 76 is centrally located along the swivel bracket 50 and is integrally formed therewith. It is contemplated that the main body 76 could be fastened, welded, or otherwise connected to the swivel bracket 50. The central shaft is coaxial with the steering axis 30. Splined disks (not shown) are provided over the portions of the central shaft that protrude from the main body 76. The splined disks are connected to the central shaft so as to be rotationally fixed relative to the central shaft. An upper generally U-shaped drive unit mounting bracket 78 has a splined opening therein that receives the upper splined disk therein. Similarly, a lower generally U-shaped drive unit mounting bracket 80 has a splined opening therein that receives the lower splined disk therein. The upper and lower drive unit mounting brackets 78, 80 are fastened to the drive unit 12 so as to support the drive unit 12 onto the bracket assembly 14. As a result, the drive unit 12, the splined disks and the central shaft are all rotationally fixed relative to each other. Anchoring end portions 82 (only the upper one of which is shown) are fastened to the upper and lower drive unit mounting brackets 78, 80 over the splined openings thereof and the ends of the central shaft, thus preventing displacement of the drive unit 12 along the steering axis 30.

The piston is engaged to the central shaft via oblique spline teeth on the central shaft and matching splines on the inside diameter of the piston. The piston is slidably engaged to the inside wall of the cylindrical main body 76 via longitudinal splined teeth on the outer diameter of the piston and matching splines on the inside diameter of the main body 76. By applying pressure on the piston, by supplying hydraulic fluid inside the main body 76 on one side of the piston, the piston slides along the central shaft. Since the main body 76 is rotationally fixed relative to the swivel bracket 50, the oblique spline teeth cause the central shaft and therefore the upper and lower drive unit mounting bracket 78, 80, to pivot about the steering axis 30. The connections between the drive unit 12 and the upper and lower drive unit mounting brackets 78, 80 cause the drive unit 12 to pivot about the steering axis 30 together with the central shaft. Supplying hydraulic fluid to one side of the piston causes the drive unit 12 to steer left. Supplying hydraulic fluid to the other side of the piston causes the drive unit 12 to steer right. In the present implementation, supplying hydraulic fluid above the piston causes the drive unit 12 to steer left and supplying hydraulic fluid below the piston causes the drive unit 12 to steer right.

U.S. Pat. No. 7,736,206 B1, issued Jun. 15, 2010, provides additional details regarding rotary actuators similar in construction to the rotary actuator 28. It is contemplated that the rotary actuator 28 could be replaced by a linear hydraulic actuator connected between the swivel bracket 50 and the drive unit 12.

The upper drive unit mounting bracket 78 has a forwardly extending arm 84. Two linkages 86 are pivotally fastened to the top of the arm 84. When more than one marine outboard engine is provided on the transom 16 of the watercraft, one or both of the linkages 86, depending on the position and number of marine outboard engines, of the marine outboard engine 10 are connected to rods which are connected at their other ends to corresponding linkages on the other marine outboard engines. Accordingly, when the marine outboard engine 10 is steered, the linkages 86 and rods cause the other marine outboard engines to be steered together with the marine outboard engine 10.

Two arms 88 extend from the upper end of the swivel bracket 50. As can be seen in FIG. 9, these arms 88 are provided with threaded apertures 90. These apertures 90 are used to fasten the box 48 to the swivel bracket 50 such that the box 48 pivots about the tilt/trim axis 24 together with the swivel bracket 50.

To supply hydraulic fluid to the rotary actuators 26, 28 and the linear actuators 22, the bracket assembly 14 is provided with a hydraulic unit 100. As best seen in FIG. 9, the hydraulic unit 100 is mounted to the swivel bracket 50 so as to pivot together with the swivel bracket 50 about the tilt-trim axis 24. It is contemplated that in some alternative implementations of the present bracket assembly 14, that the hydraulic unit 100 or some elements thereof could be mounted to the stern bracket 52 instead.

Figure 12:
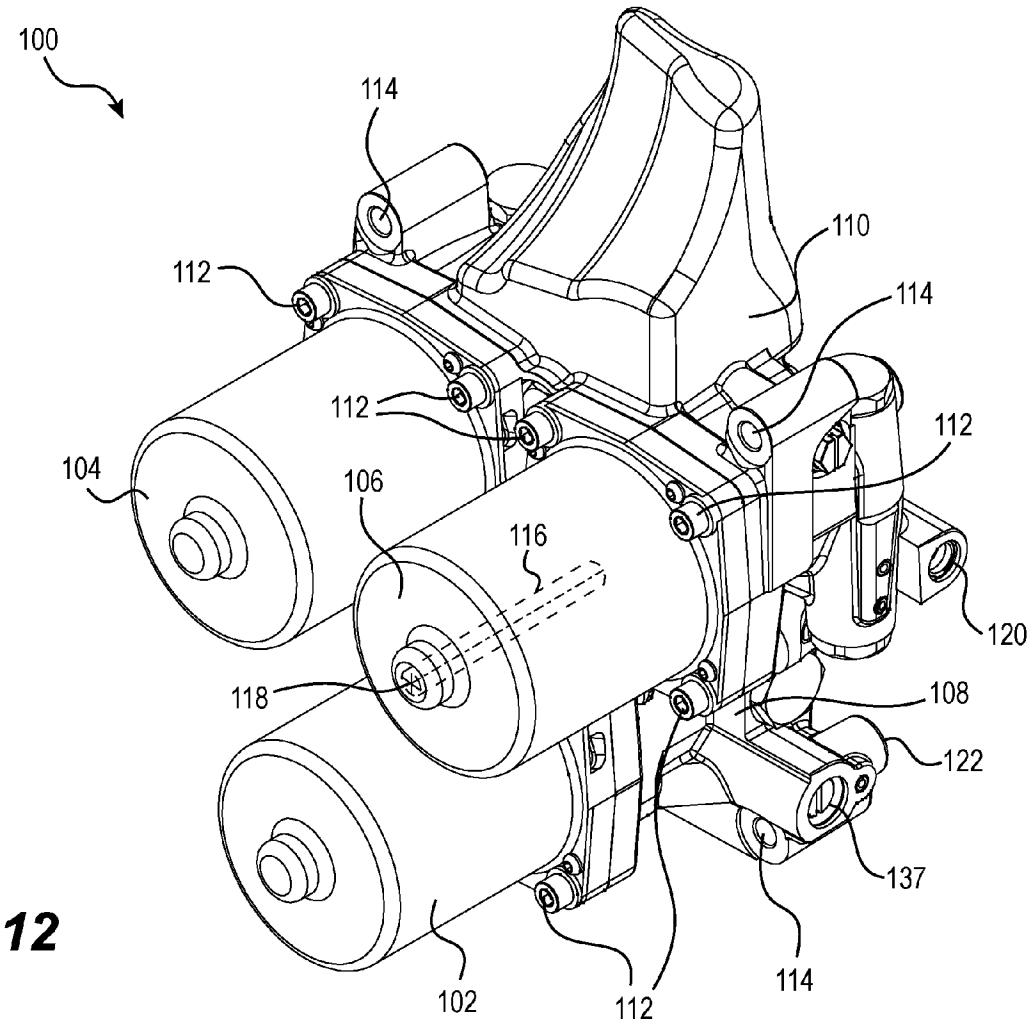
FIG. 12 is a perspective view taken from a front, left side of a hydraulic unit of the bracket assembly of FIG. 7.
Figure 14:
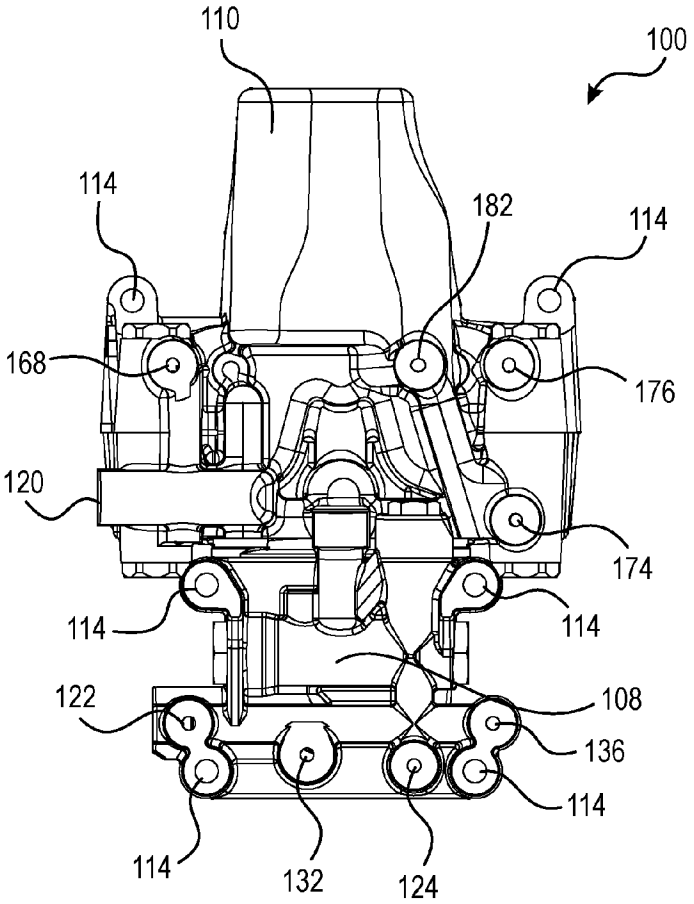
FIG. 14 is a rear elevation view of the hydraulic unit of FIG. 12.
Figure 13:
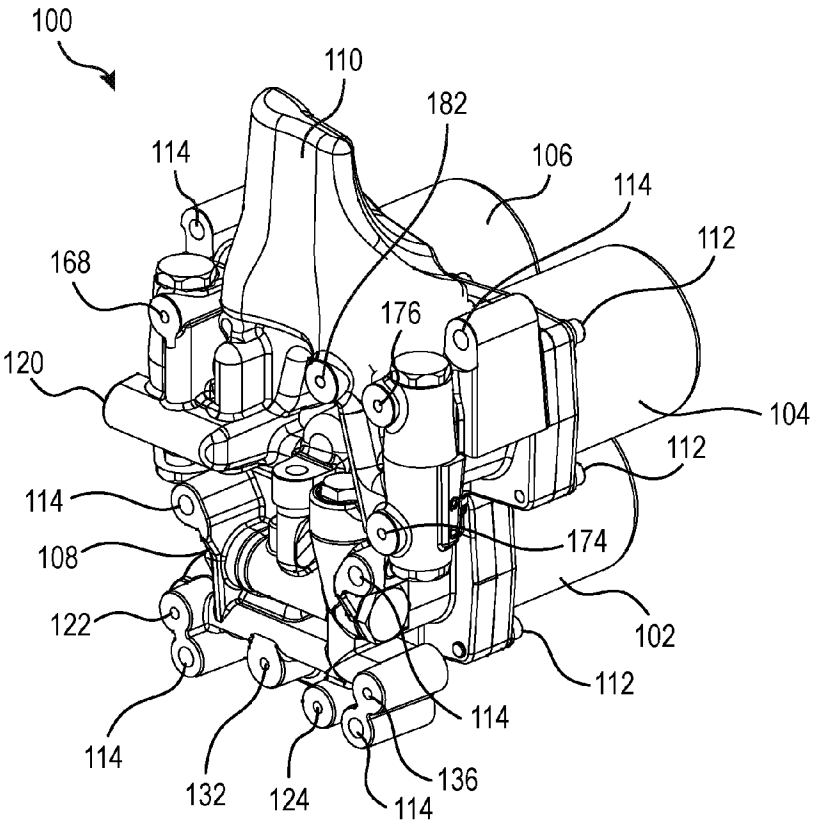
FIG. 13 is a perspective view taken from a rear, right side of the hydraulic unit of FIG. 12.

As best seen in FIGS. 12 to 14, the hydraulic unit 100 includes three pumps 102, 104, 106, a valve unit 108, and a hydraulic fluid reservoir 110. The pumps 102, 104, 106 are mounted via fasteners 112 to the valve unit 108. The valve unit 108 is mounted to the swivel bracket 50 via fasteners (not shown) inserted into apertures 114 provided in the valve unit 108. The fluid reservoir 110 is disposed on top of the valve unit 108 and is fastened to the valve unit 108.

Figure 8:
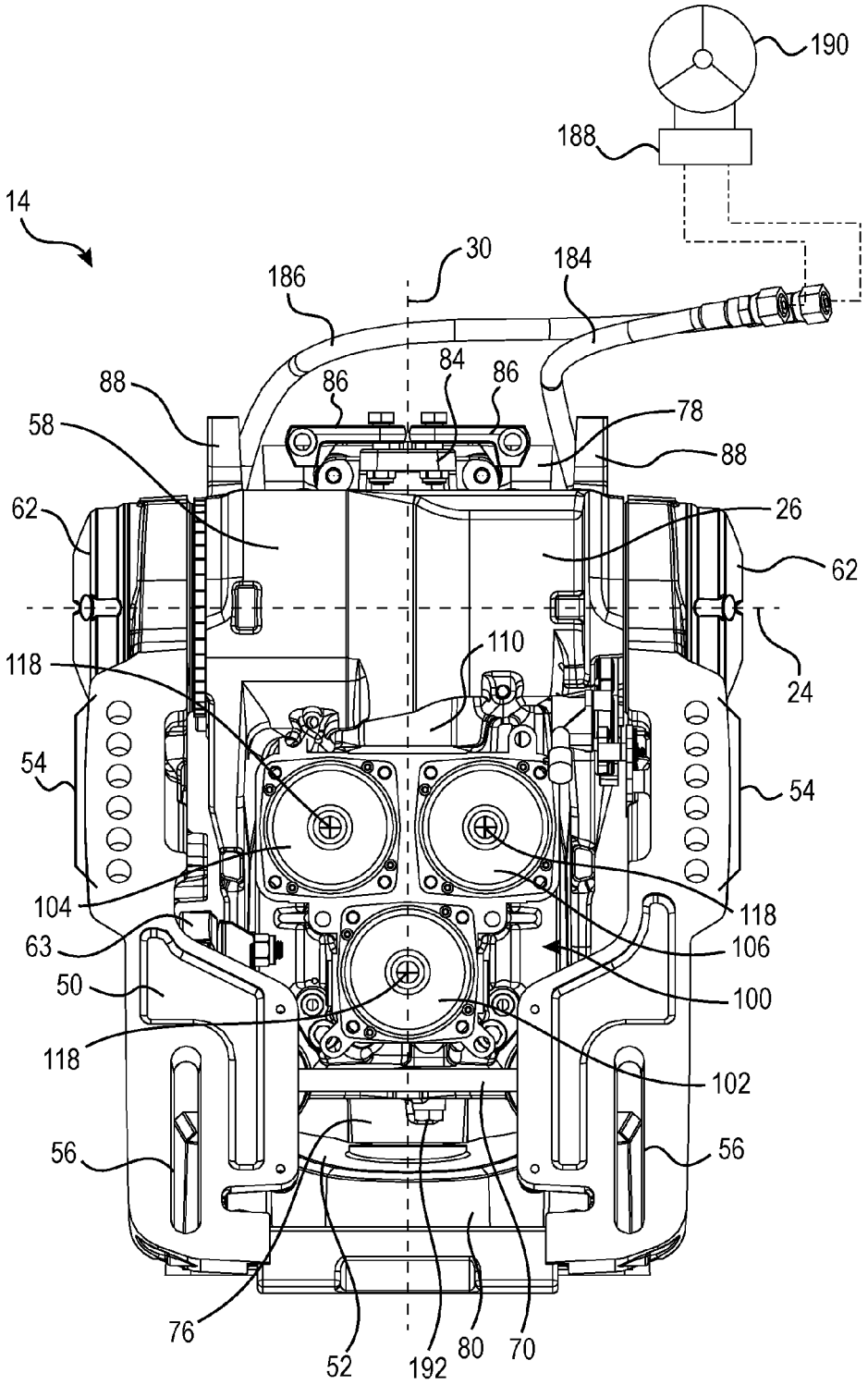
FIG. 8 is a front elevation view of the bracket assembly of FIG. 7.

As best seen in FIG. 8, when they are mounted to the swivel bracket 50, the pumps 102, 104, 106 are disposed in a triangular arrangement. In this arrangement, the pump 102 is disposed on a lower half of the swivel bracket 50 along a lateral center of the swivel bracket 50, which corresponds to the steering axis 30 in FIG. 8.

The pumps 102, 104, 106 are bi-directional electric pumps. Each pump 102, 104, 106 includes a motor (not shown), a shaft 116 (shown in dotted lines only for pump 106 in FIG. 12) and a pumping member (not shown). The motor is connected to the shaft 116 which is itself connected to the pumping member. The motor drives the pumping member by causing the shaft 116 to rotate about a pump axis 118. The direction of the flow of hydraulic fluid from each pump 102, 104, 106 can be changed by changing the direction of rotation of their respective motors. It is contemplated that the pumps 102, 104, 106 could be unidirectional pumps, in which case it is contemplated that a system of valves could be used to vary the direction of the flow. It is also contemplated that other types of pumps could be used, such as, for example, axial flow pumps or reciprocating pumps. When they are mounted to the swivel bracket 50, the pump axes 118 of the pumps 102, 104, 106 are generally perpendicular to the tilt/trim axis 24 and to the steering axis 30 as can be seen in FIG. 8. The volume of each pump 102, 104, 106 acts as a hydraulic fluid reservoir.

The pump 102 is used to supply hydraulic fluid to the rotary actuator 26 and the linear actuators 22. Therefore, actuation of the pump 102 controls the tilt and trim. It is contemplated that the pump 102 could be replaced with two pumps: one controlling the upward motion (tilt/trim up) and one controlling the downward motion (tilt/trim down). The pump 102 is fluidly connected to the fluid reservoir 110 via the valve unit 108. The fluid present in the reservoir 110 and the volume of the reservoir 110 account for the variation in volume of hydraulic fluid in the hydraulic circuit to which the pump 102 is connected that is caused by the displacement of the pistons 66 in the linear actuators 22.

Hydraulic fluid can be added to the fluid reservoir 110 via a reservoir inlet 120. When the hydraulic unit 100 is mounted to the swivel bracket 50, the reservoir inlet 120 is in alignment with an aperture (not shown) in the side of the swivel bracket 50. As such, the reservoir 110 can be filled without having to remove it from the swivel bracket 50. As can be seen in FIG. 12, the reservoir inlet 120 is located below the main volume of the reservoir 110 when the swivel bracket is in the upright position. To fill the reservoir 110, the swivel bracket 50 is tilted up to its highest position. This brings at least a portion of the main volume of the reservoir 110 below the reservoir inlet 120. Filling the reservoir 110 in this position up to the level of the inlet 120 ensures that the proper amount of hydraulic fluid is present in the reservoir 110.

Figure 17:
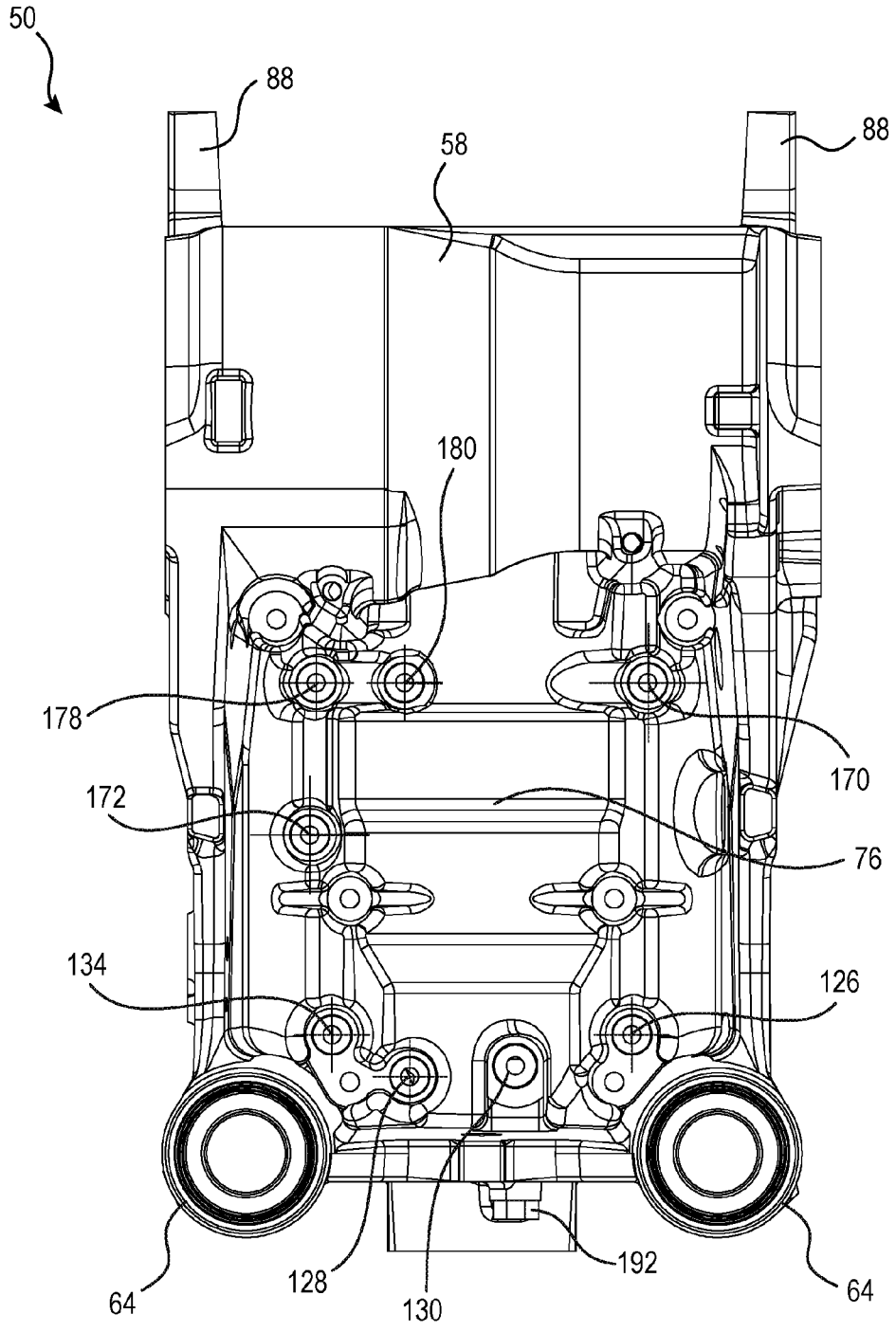
FIG. 17 is a front elevation view of a swivel bracket of the bracket assembly of FIG. 7.
Figure 19:
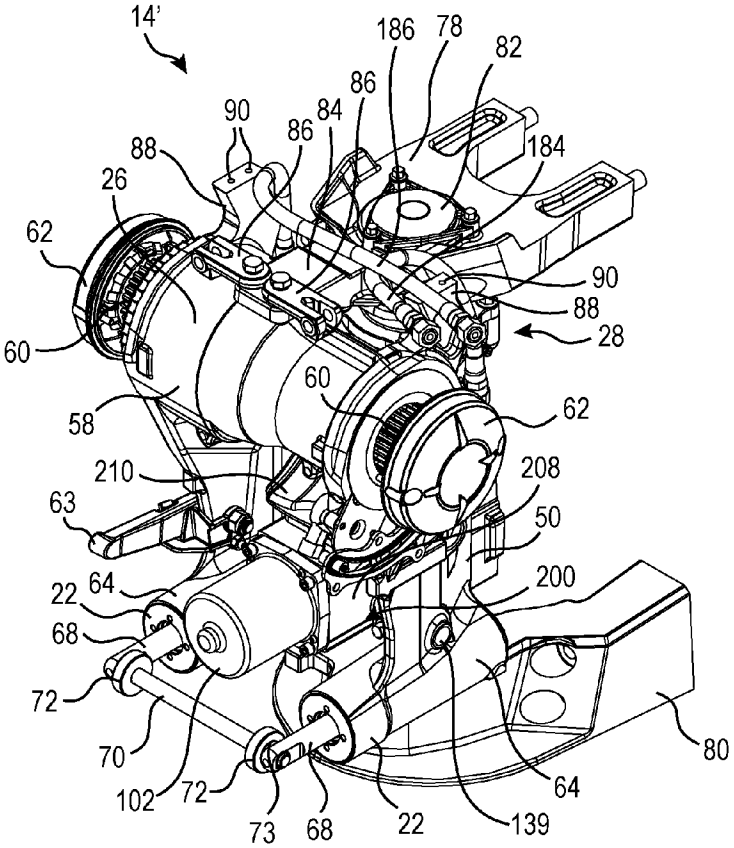
FIG. 19 is a perspective view taken from a front, left side of the bracket assembly of FIG. 18 with the stern bracket removed.

The pump 102 is fluidly connected to a valve assembly located in the valve unit 108. To trim the swivel bracket 50 up, the pump 102 pumps fluid from the reservoir 110 and fluid from the pump 102 is caused by the valve assembly to flow out of apertures 122, 124 in the valve unit 108. From the aperture 122, the fluid flows to an aperture 126 in the swivel bracket 50 (FIG. 17). From the aperture 126, the fluid flows in a passage (not shown) integrally formed in the swivel bracket 50 to the left linear actuator 22. From the aperture 124, the fluid flows to an aperture 128 in the swivel bracket 50 (FIG. 17). From the aperture 128, the fluid flows in a passage (not shown) integrally formed in the swivel bracket 50 to the right linear actuator 22. As explained above, this causes both linear actuators 22 to push the swivel bracket 50 away from the stern bracket 52. To trim the swivel bracket 50 down, fluid is drawn from both linear actuators 22 by the pump 102. From the linear actuators 102, fluid flows through passages (not shown) integrally formed in the swivel bracket 50 to an aperture 130 in the swivel bracket 50 (FIG. 17). From the aperture 130, fluid flows in an aperture 132 in the valve unit 108 and back to the pump 102 and the reservoir 110.

To tilt the swivel bracket 50 up, fluid from the pump 102 is caused by the valve assembly to flow out of the aperture 122 in the valve unit 108, through the aperture 126 in the swivel bracket 50. From the aperture 126, fluid flows in another passage (not shown) integrally formed in the swivel bracket 50 to a port (not shown) in the main body 58 to supply the fluid to the left side of the piston of the rotary actuator 26. As this occurs, fluid on the right side of the piston of the rotary actuator 26 flows out of another port (not shown) in the main body 58 into another passage (not shown) integrally formed in the swivel bracket 50. From this passage, fluid flows out of an aperture 134 (FIG. 17) in the swivel bracket 50 into an aperture 136 in the valve unit 108 and back to the pump 102. As explained above, this causes the swivel bracket 50 to pivot away from the stern bracket 52.

To tilt the swivel bracket 50 down, fluid from the pump 102 is caused by the valve assembly to flow out of the aperture 136 in the valve unit 108, into the aperture 134 in the swivel bracket 50 and to the port in the main body 58 to supply hydraulic fluid to the right side of the piston of the rotary actuator 26. As this occurs, fluid on the left side of the piston of the rotary actuator 26 flows out of its associated port to the aperture 126 in the swivel bracket 50, into the aperture 122 in the valve unit 108 and back to the pump 102.

It should be noted that, as the swivel bracket 50 is being trimmed up or down by the linear actuators 22, fluid is being simultaneously supplied to the rotary actuator 26 to obtain the same amount of angular movement in the same direction and at the same rate.

A screw 137 (FIG. 12) provided on the left side of the valve unit 108 can be turned manually to open a manual release valve (not shown) to permit the drive unit 12 to be turned freely about the tilt/trim axis 24. To access the screw 137, an aperture 139 (FIG. 9) is defined in the side of the swivel bracket.

The pump 102 is actuated in response to the actuation by the driver of the watercraft of tilt and trim actuators (not shown) in the form of switches, buttons or levers for example. It is contemplated that the pump 102 could also be controlled by a control unit of the outboard engine 10 or of the watercraft to automatically adjust a trim of the drive unit 12 based on various parameters such as watercraft speed, engine speed and engine torque for example.

Figure 15:
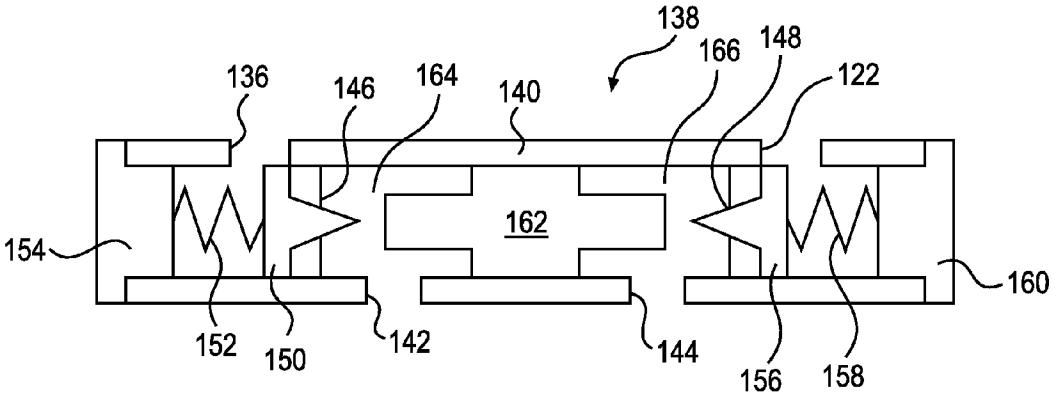
FIG. 15 is a schematic representation of valves of the hydraulic unit of FIG. 12 with the valves is a closed position.
Figure 16:
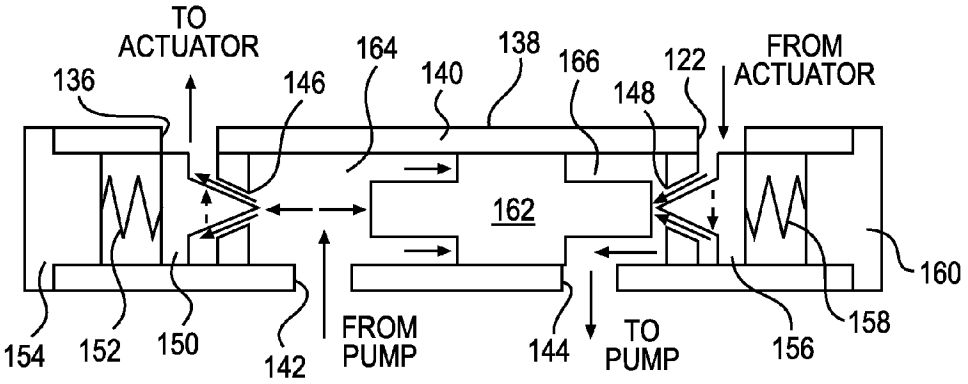
FIG. 16 is a schematic representation of the valves of FIG. 15 with the valves is an opened position.

The valve assembly used to open and close the apertures 122 and 136 is a shuttle type spool valve similar to the one schematically illustrated in FIGS. 15 and 16 (i.e. valve assembly 138). The valve assembly 138 includes a body 140 in which are formed the apertures 122, 136, 142 and 144. The apertures 142 and 144 fluidly communicated with the pump 102. Valve ports 146, 148 are formed in the body 140. A valve body 150 is biased by a spring 152 to normally close the port 146. A threaded cap 154 is located at the end of the body 140 where the spring 152 is located. A valve body 156 is biased by a spring 158 to normally close the port 148. A threaded cap 160 is located at the end of the body 140 where the spring 158 is located. A shuttle 162 is disposed in the body 140 between the valve ports 146, 148 and the apertures 142, 144, thus forming two variable volume chambers 164, 166 in the body 140.

When the pump 102 is not being operated, the valve assembly 138 is in the configuration shown in FIG. 15. Any hydraulic pressure being applied by the piston of the rotary actuator 26 forces the valve bodies against the ports 146, 148, thus preventing fluid flow to the pump 102.

When the pump 102 is operated to supply fluid through aperture 142, as in FIG. 16, the hydraulic pressure created in the chamber 164 pushes against the valve body 150, overcoming the bias of the spring 152, and thus opening the port 146. As a result, the hydraulic fluid can flow out of the aperture 136 to the rotary actuator 26 to tilt the swivel bracket 50 down. The hydraulic pressure created in the chamber 164 also pushes against the shuttle 162 which in turn pushes the protruding tip of the valve body 156, thus overcoming the bias of the spring 158 and opening the port 148. This allows fluid in the rotary actuator 26 that is displaced by the motion of the piston in the rotary actuator 26 to flow from the aperture 122 to the aperture 144 and back to the pump 102.

As would be understood, when the pump 102 is operated to supply fluid through aperture 144, the hydraulic pressure created in the chamber 166 opens the port 148 and causes the shuttle 162 to open the port 146. Therefore, hydraulic fluid can flow in the direction opposite to the one illustrated in FIG. 16.

It is contemplated that other types of valves or valve assemblies could be used instead of the valve assembly 128.

The pumps 104 and 106 are used to supply hydraulic fluid to the rotary actuator 28. Therefore, actuation of the pumps 104 and 106 control left and right steering of the drive unit 12. In the present implementation, both pumps 104, 106 are used for both left and right steering motion. It is contemplated that only one of the pumps 104, 106 could be used for providing the left steering motion with the other one of the pumps 104, 106 being used for providing the right steering motion. It is also contemplated that each one of the pumps 104, 106 could normally be used for providing one steering motion each with the other one of the pumps 104, 106 being used to provide a boost in pressure to steer when needed or to provide the pressure in case of failure of the pump normally being used to steer in a particular direction. It is also contemplated that only one pump could be used to supply the hydraulic pressure to the rotary actuator 28 to steer both left and right.

The pumps 104, 106 are fluidly connected to valve assemblies located in the valve unit 108. The valve assemblies are similar to the valve assembly 138 described above, but it is contemplated that other types of valves and valve assemblies could be used.

To steer the drive unit 12 to the left, fluid from the pumps 104, 106 is caused by the valve assemblies to flow out of an aperture 168 in the valve unit 108 into an aperture 170 in the swivel bracket 50 (FIG. 17). From the aperture 170, fluid flows in a passage (not shown) integrally formed in the swivel bracket 50 to a port (not shown) in the main body 76 of the rotary actuator 28 to supply the fluid above the piston of the rotary actuator 28. As this occurs, fluid on the bottom of the piston of the rotary actuator 28 flows out of another port (not shown) in the main body 76 into another passage (not shown) integrally formed in the swivel bracket 50. From this passage, fluid flows out of an aperture 172 in the swivel bracket 50 (FIG. 17) into an aperture 174 in the valve unit 108 and back to the pumps 104, 106. As explained above, this causes the drive unit to steer left.

To steer the drive unit 12 to the right, fluid from the pumps 104, 106 is caused by the valve assemblies to flow out of an aperture 176 in the valve unit 108 into an aperture 178 in the swivel bracket 50 (FIG. 17). From the aperture 178, fluid flows in a passage (not shown) integrally formed in the swivel bracket 50 to a port (not shown) in the main body 76 of the rotary actuator 28 to supply the fluid below the piston of the rotary actuator 28. As this occurs, fluid on the top of the piston of the rotary actuator 28 flows out of another port (not shown) in the main body 76 into another passage (not shown) integrally formed in the swivel bracket 50. From this passage, fluid flows out of the aperture 172 in the swivel bracket 50 (FIG. 17) into the aperture 174 in the valve unit 108 and back to the pumps 104, 106. As explained above, this causes the drive unit to steer right.

The swivel bracket 50 is also provided with an aperture 180 (FIG. 17) that fluidly communicates with the rotary actuator 28 via passages (not shown) integrally formed in the swivel bracket 50. The aperture 180 communicates with an aperture 182 in the valve unit 108. The aperture 182 fluidly communicates with the reservoir 110 via passages (not shown) in the valve unit 108. A normally closed pressure relief valve (not shown) is disposed in the valve unit 108 between the aperture 182 and the reservoir 110. Should the pressure in the hydraulic circuit between the pumps 104, 106 and the rotary actuator 28 exceed a predetermined amount, the pressure relief valve opens causing the hydraulic fluid to go in the fluid reservoir 110, thus preventing further increase in hydraulic pressure.

The pumps 104, 106 are actuated in response to signals received from one or more sensors sensing a position of a helm assembly 190 of the watercraft.

Figure 7:
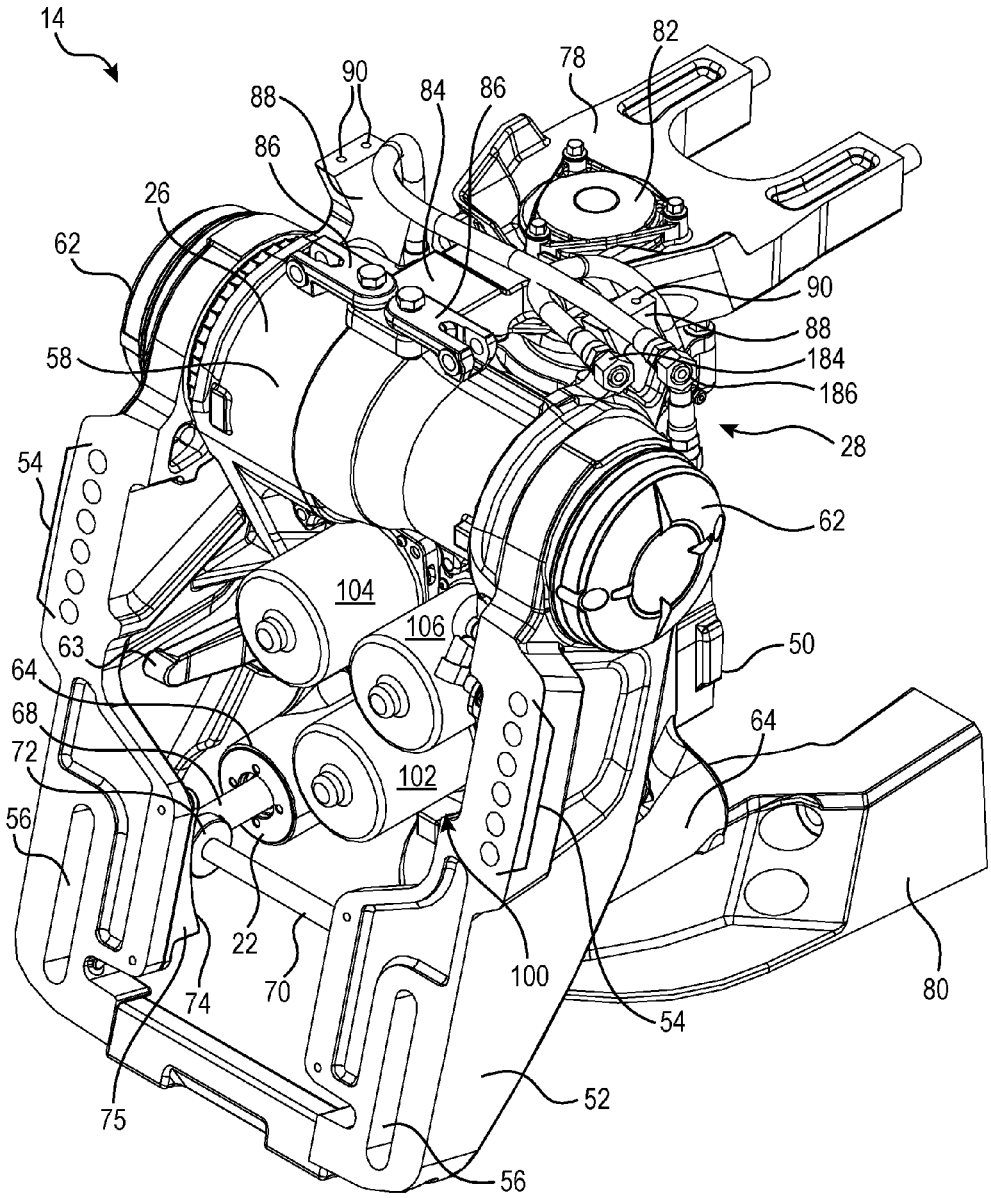
FIG. 7 is a perspective view taken from a front, left side of a bracket assembly of the outboard engine of FIG. 1.

As illustrated in FIGS. 7 to 9, the bracket assembly 14 is provided with hydraulic lines 184, 186 connected to openings (not shown) in the sides of the swivel bracket 50. The opening in the swivel bracket 50 for the line 184 communicates with a passage in the swivel bracket 50 that is connected to the passage between the aperture 170 of the swivel bracket 50 and the rotary actuator 28. The opening in the swivel bracket 50 for the line 186 communicates with a passage in the swivel bracket 50 that is connected to the passage between the aperture 178 of the swivel bracket 50 and the rotary actuator 28. The lines 184, 186 are routed through the box 48 and are fluidly connected to a hydraulic actuator 188 driven by the helm assembly 190 of the watercraft as schematically illustrated in FIG. 8. When the driver turns the helm assembly 190 left, the actuator 188 pushes hydraulic fluid in the line 184, which is then supplied to the rotary actuator 28 to cause the drive unit 12 to turn left. When the driver turns the helm assembly 190 right, the actuator 188 pushes hydraulic fluid in the line 186 which is then supplied to the rotary actuator 28 to cause the drive unit 12 to turn right. The pumps 104, 106 are actuated as indicated above in response to rotation of the helm assembly 190 to supplement the hydraulic pressure supplied by the lines 184, 186. The hydraulic lines 184, 186 are optional. When the optional lines 184, 186 are not being used, as in the case of a steering-by-wire system, their respective openings in the swivel bracket 50 are capped.

To drain the hydraulic fluid from the hydraulic unit 100, a threaded fastener 192 (FIG. 8) is removed from an aperture (not shown) in the bottom of the swivel bracket 50. Hydraulic fluid from the hydraulic unit 100 flows out of the aperture 132 in the valve unit 108, into the aperture 130 in the swivel bracket 50, through a passage integrally formed in the swivel bracket 50, and out through the aperture at the bottom of the swivel bracket 50.

When the hydraulic unit 100 is mounted to the swivel bracket 50, every aperture of the valve unit 108 is in alignment with and adjacent to its corresponding aperture in the swivel bracket 50. As such, no hydraulic lines need to be connected between corresponding apertures, which simplifies the mounting of the hydraulic unit 100 to the swivel bracket 50.

Turning now to FIGS. 18 to 22, a bracket assembly 14', which is an alternative implementation of the bracket assembly 14 described above, will be described. The bracket assembly 14' is the same as the bracket assembly 14 except that the hydraulic unit 100 has been replaced with a hydraulic unit 200. Therefore, for simplicity, elements of the bracket assembly 14' that are the same as those of the bracket assembly 14 have been labeled with the same reference numerals and will not be described again in detail.

The hydraulic unit 200 includes a pump 102 (same type as above), a valve unit 208, and a hydraulic fluid reservoir 210. The pump 102 is mounted via fasteners 112 to the valve unit 208. The valve unit 208 is mounted to the swivel bracket 50 via fasteners inserted into apertures 114 provided in the valve unit 208. The fluid reservoir 210 is disposed on top of the valve unit 208 and is fastened to the valve unit 208.

Figure 18:
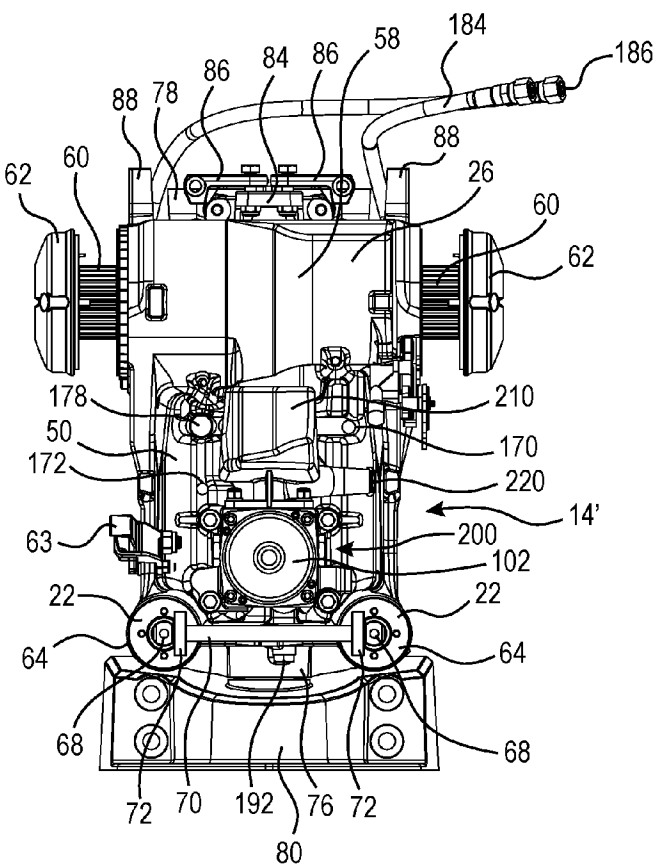
FIG. 18 is a front elevation view of an alternative implementation of a bracket assembly of the outboard engine of FIG. 1 with a stern bracket removed.
Figure 20:
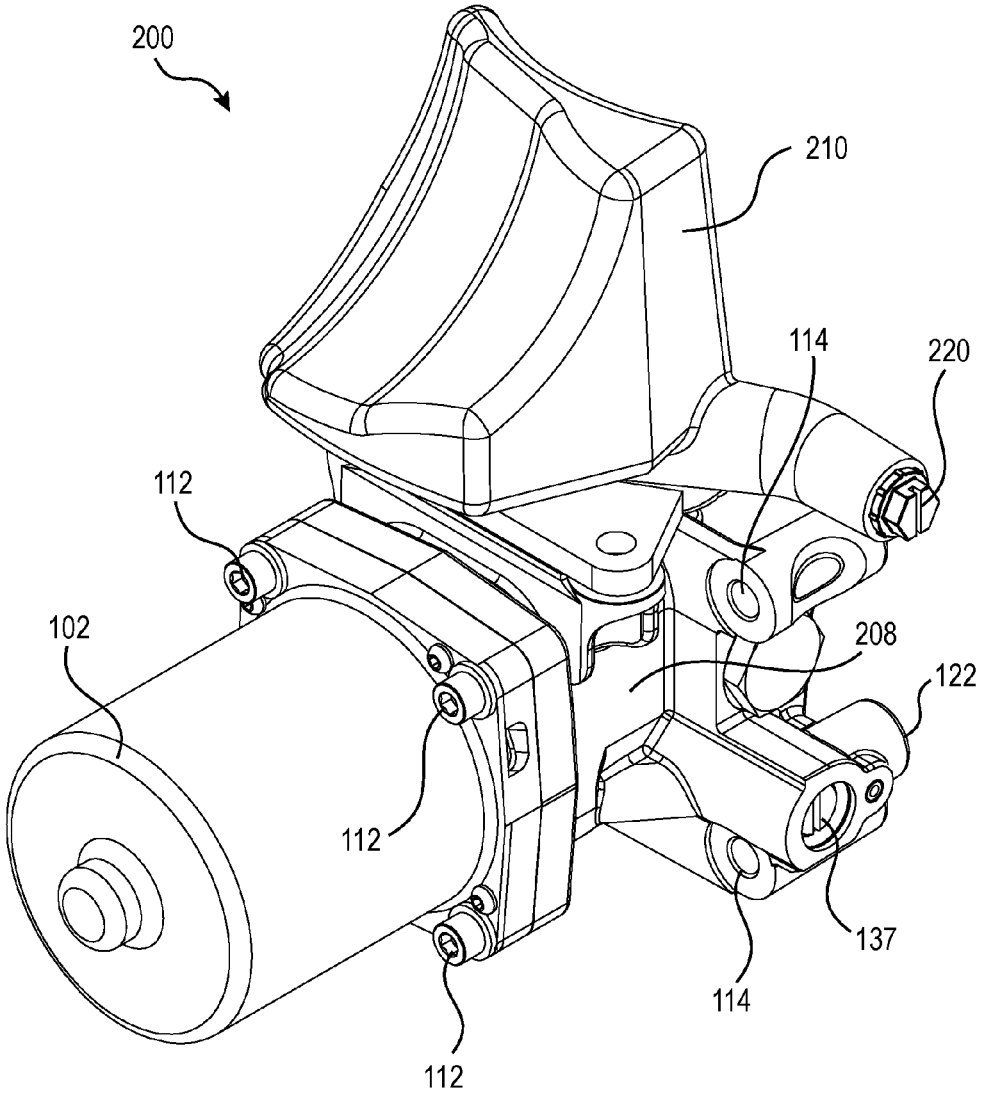
FIG. 20 is a perspective view taken from a front, left side of a hydraulic unit of the bracket assembly of FIG. 18.
Figure 22:
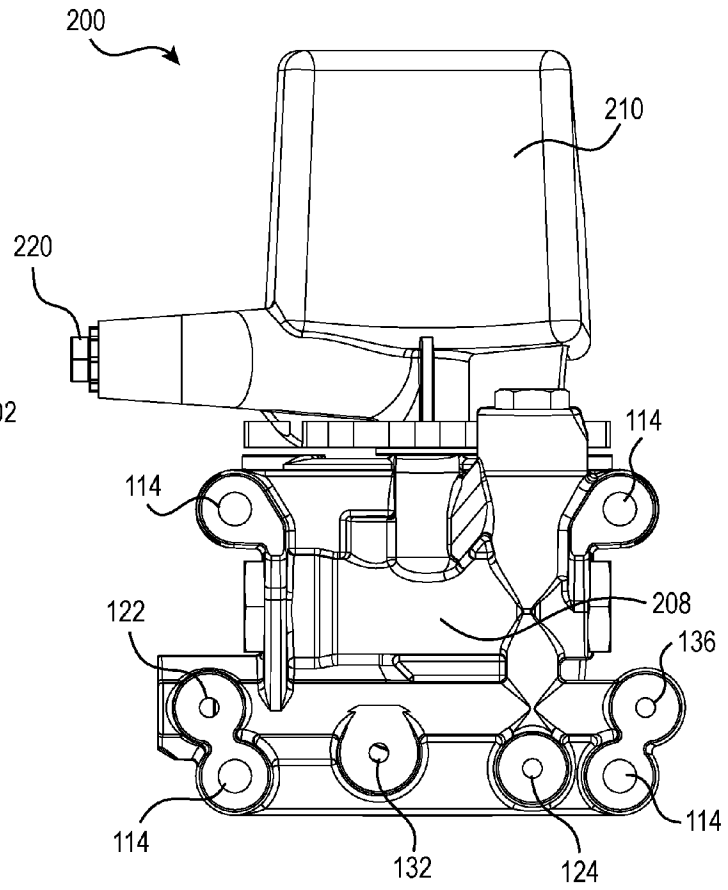
FIG. 22 is a rear elevation view of the hydraulic unit of FIG. 20.
Figure 21:
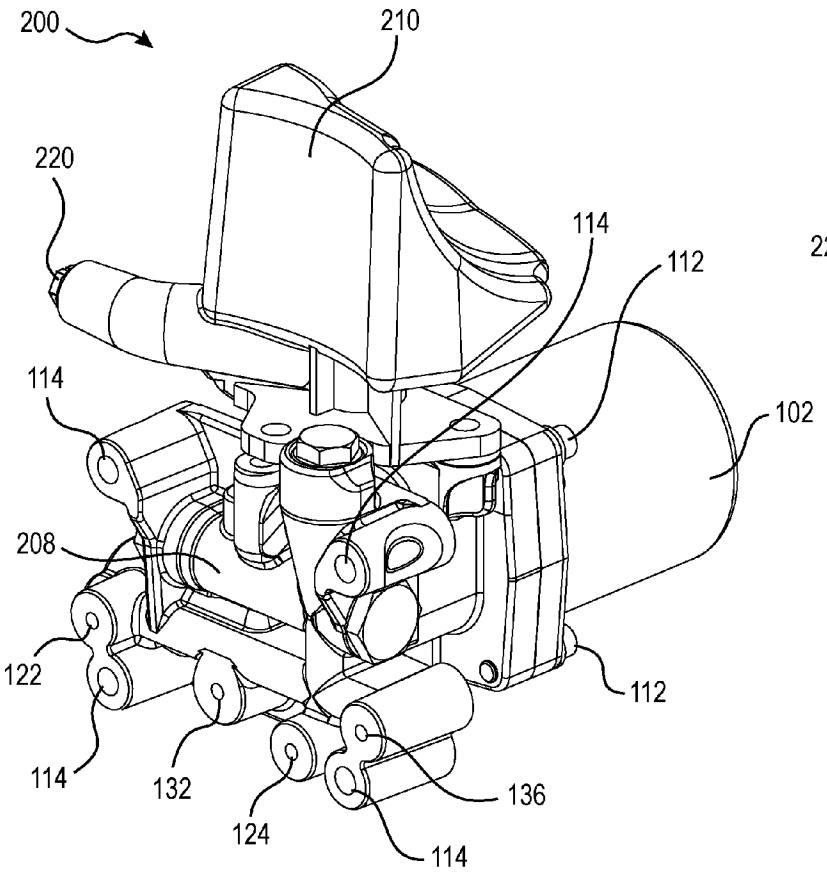
FIG. 21 is a perspective view taken from a rear, right side of the hydraulic unit of FIG. 20.

As best seen in FIG. 18, the pump 102 is disposed on a lower half of the swivel bracket 50 along a lateral center of the swivel bracket 50, which corresponds to the steering axis 30.

The valve unit 208 corresponds to the lower part of the valve unit 108 described above. As such, the valve unit 208 is provided with apertures 122, 124, 132 and 136 that perform the same function and communicate with the same apertures in the swivel bracket 50 as the apertures 122, 124, 132 and 136 of the valve unit 108. As would be understood, the pump 102 is therefore used in tilting and trimming the swivel bracket 50 relative to the stern bracket 52.

The reservoir 210 fluidly communicates with the valve unit 208 to supply fluid to or receive fluid from the valve unit 208. The reservoir has a reservoir inlet 220 that is used to fill the reservoir 210 in the same manner as the reservoir inlet 120 of the reservoir 110 described above. The reservoir 210 and its inlet 220 are shaped differently from the reservoir 110 and its inlet 120 in order to properly be received in its different location on the swivel bracket 52.

Since the hydraulic unit 200 is not provided with pumps to supply hydraulic fluid to the rotary actuator 28 used to steer the drive unit 12, in order to steer the drive unit 12, hydraulic fluid is provided to the rotary actuator 28 via the lines 184, 186 from the hydraulic actuator 188 driven by the helm assembly 190 of the watercraft in the same manner as is schematically illustrated in FIG. 8. The apertures 170, 172, 178 and 180 of the swivel bracket 50 are therefore capped, as they are not being used in this implementation. It is contemplated that the swivel bracket 50 could be replaced by a different swivel bracket that does not have the apertures 170, 172, 178 and 180.

It is contemplated that the hydraulic unit 200 could have a different valve unit 208 that has additional apertures, valves and valves assemblies, such that the valve unit 208 would fluidly communicate with the apertures 170, 172, 178 and 180 in the swivel bracket 50 such that the pump 102 would be used for tilting, trimming and steering the drive unit 12. It is also contemplated that at least some elements of the hydraulic unit 200 could be mounted to the stern bracket 52.

Turning now to FIGS. 23 to 33, a bracket assembly 14", which is an alternative implementation of the bracket assemblies 14 and 14' described above, will be described. The bracket assembly 14" is the same as the bracket assembly 14' except that the reservoir 210 of the hydraulic unit 200 has been removed, a hydraulic unit 300 used for steering has been added, and the swivel bracket 50 has been replaced by a swivel bracket 50". It is contemplated that the hydraulic unit 200 could be replaced by another type of hydraulic unit 200. The swivel bracket 50" is the same as the swivel bracket 50 except that the apertures 170, 172, 178 and 180 have been replaced with apertures, described further below, which are suitably located for use with the hydraulic unit 300. Therefore, for simplicity, elements of the bracket assembly 14" that are the same as those of the bracket assemblies 14 and 14' have been labeled with the same reference numerals and will not be described again in detail.

Figure 33:
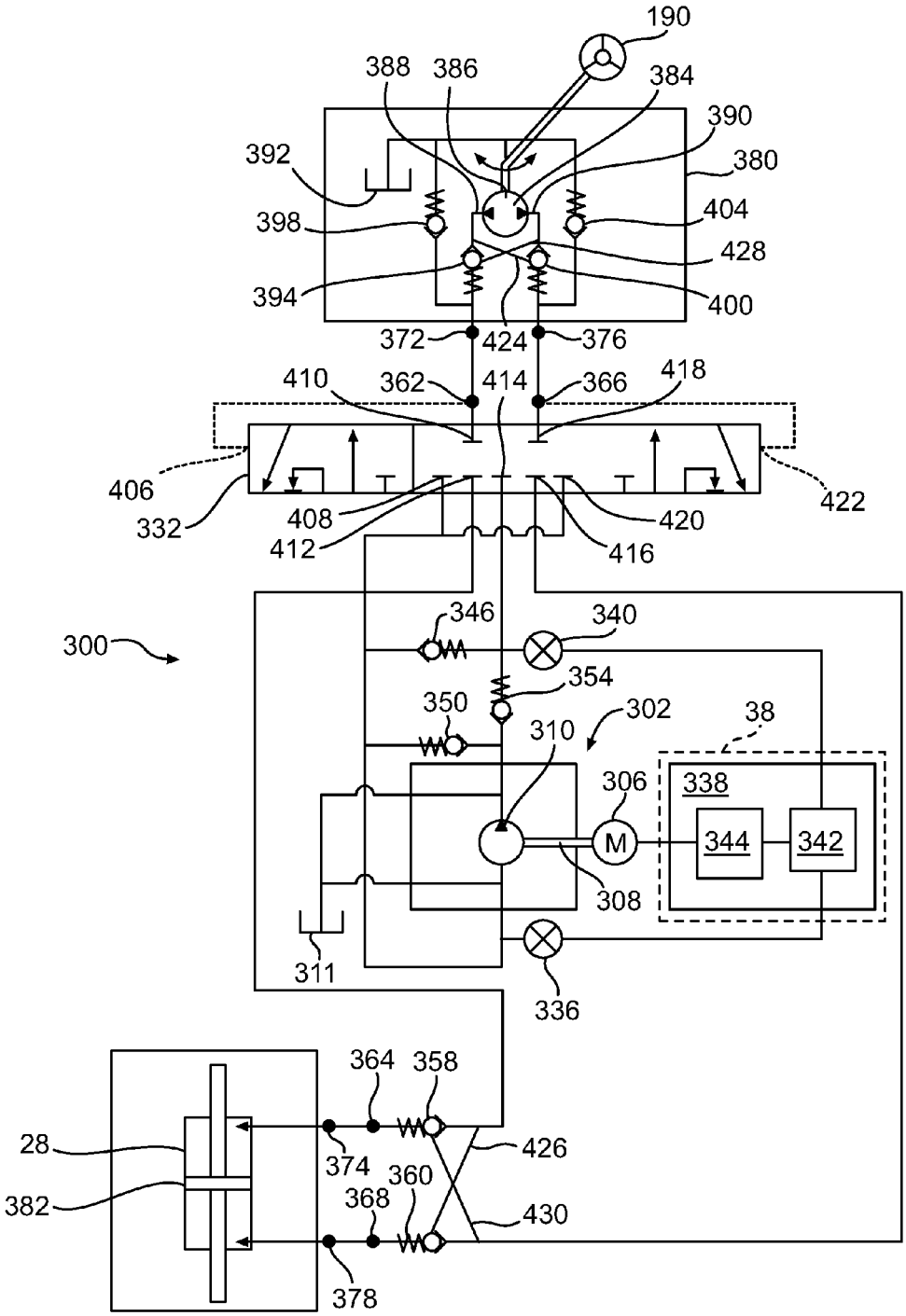
FIG. 33 is a hydraulic circuit diagram of the hydraulic unit of FIG. 25 and its associated components.

The hydraulic unit 300 includes a pump 302, and a valve unit 304. The pump 302 is a unidirectional electric pump, but it is contemplated that other types of pumps could be used. The pump 302 is used to supply hydraulic fluid to the rotary actuator 28. Therefore, actuation of the pump 302 controls left and right steering of the drive unit 12. It is contemplated that two pumps could be used to control steering as in the hydraulic unit 100 described above. As is schematically illustrated in FIG. 33, the pump 302 includes a motor 306, a shaft 308 and a pumping member 310. The motor 306 is connected to the shaft 308 which is itself connected to the pumping member 310. The motor 306 is disposed outside the valve unit 304, the pumping member 310 is disposed inside the valve unit 304, and the shaft 308 extends between the two. The valve unit 304 defines a hydraulic fluid reservoir 311 (FIG. 28) around the pumping member 310. The motor 306 drives the pumping member 310 by causing the shaft 308 to rotate about a pump axis 312. The pump axis 312 is parallel to the tilt/trim axis 24 and perpendicular to the steering axis 30. The pump 302 is mounted via fasteners 314 to the valve unit 304. The valve unit 304 is mounted to the swivel bracket 50" via fasteners inserted into apertures 316 (FIG. 25) provided in the valve unit 308 and into apertures 318 (FIG. 29) provided in the swivel bracket 50".

Figure 23:
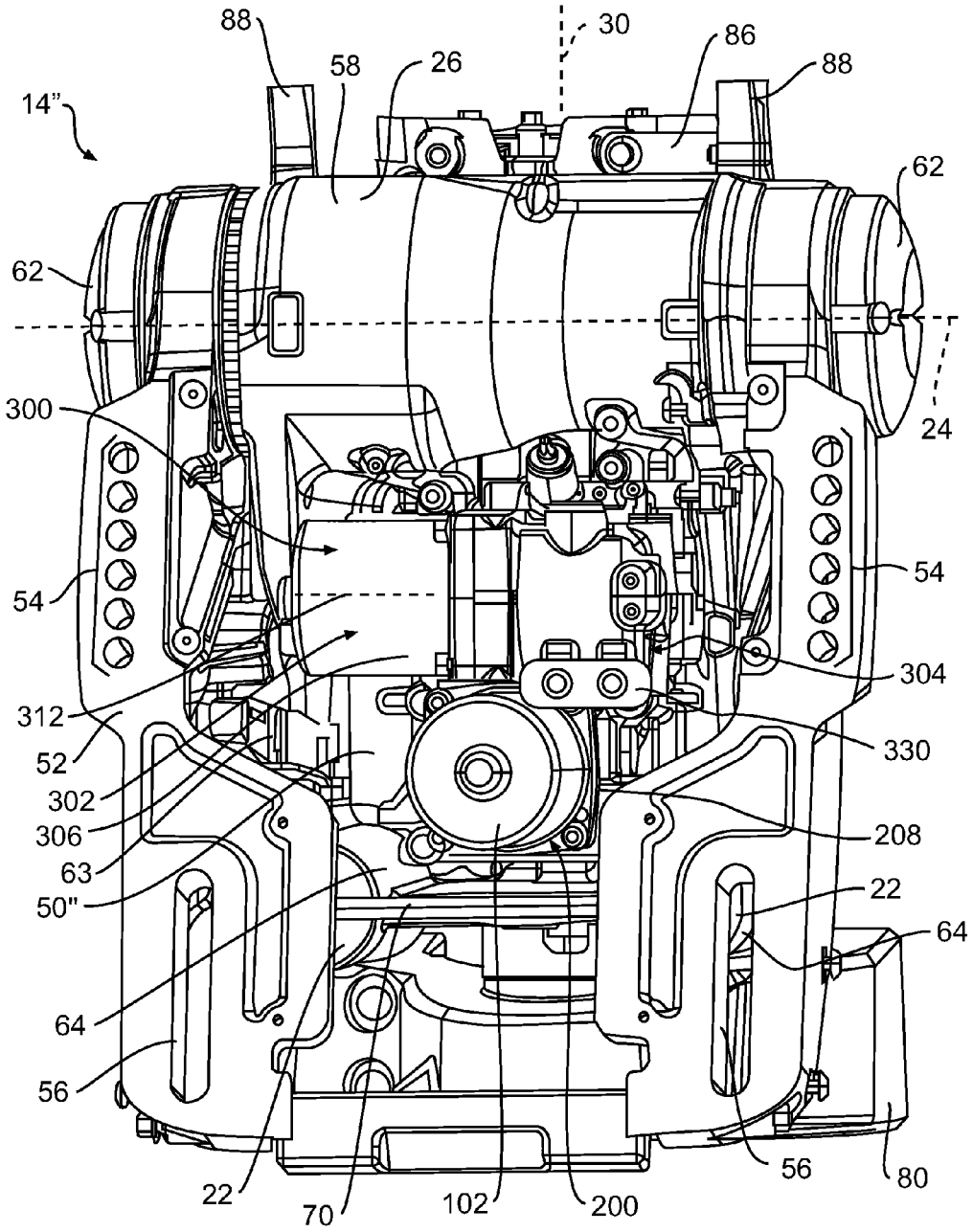
FIG. 23 is a perspective view taken from a front, left side of another alternative implementation of a bracket assembly of the outboard engine of FIG. 1.
Figure 24:
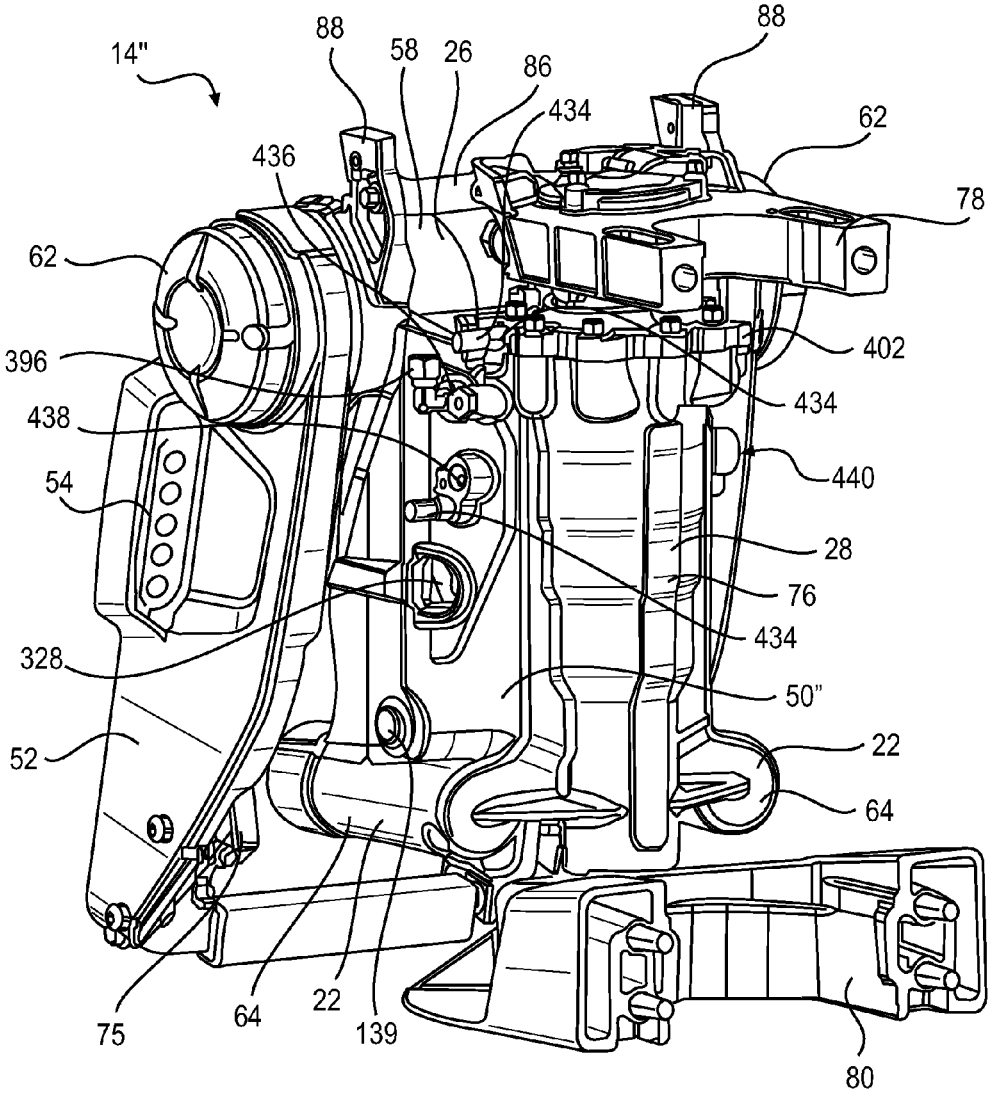
FIG. 24 is a perspective view taken from a rear, left side of the bracket assembly of FIG. 23.
Figure 27:
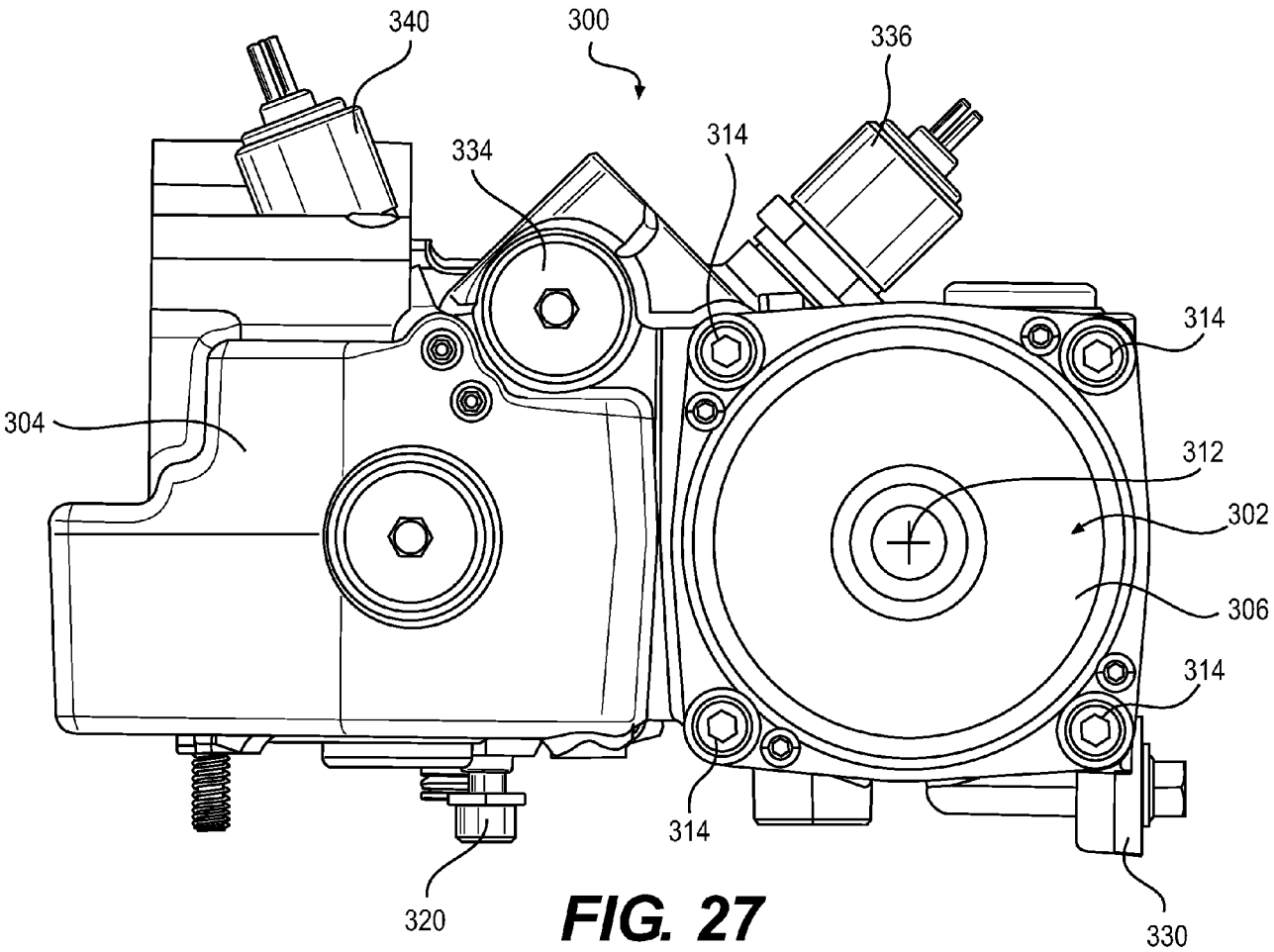
FIG. 27 is a right side elevation view of the hydraulic unit of FIG. 25.
Figure 28:
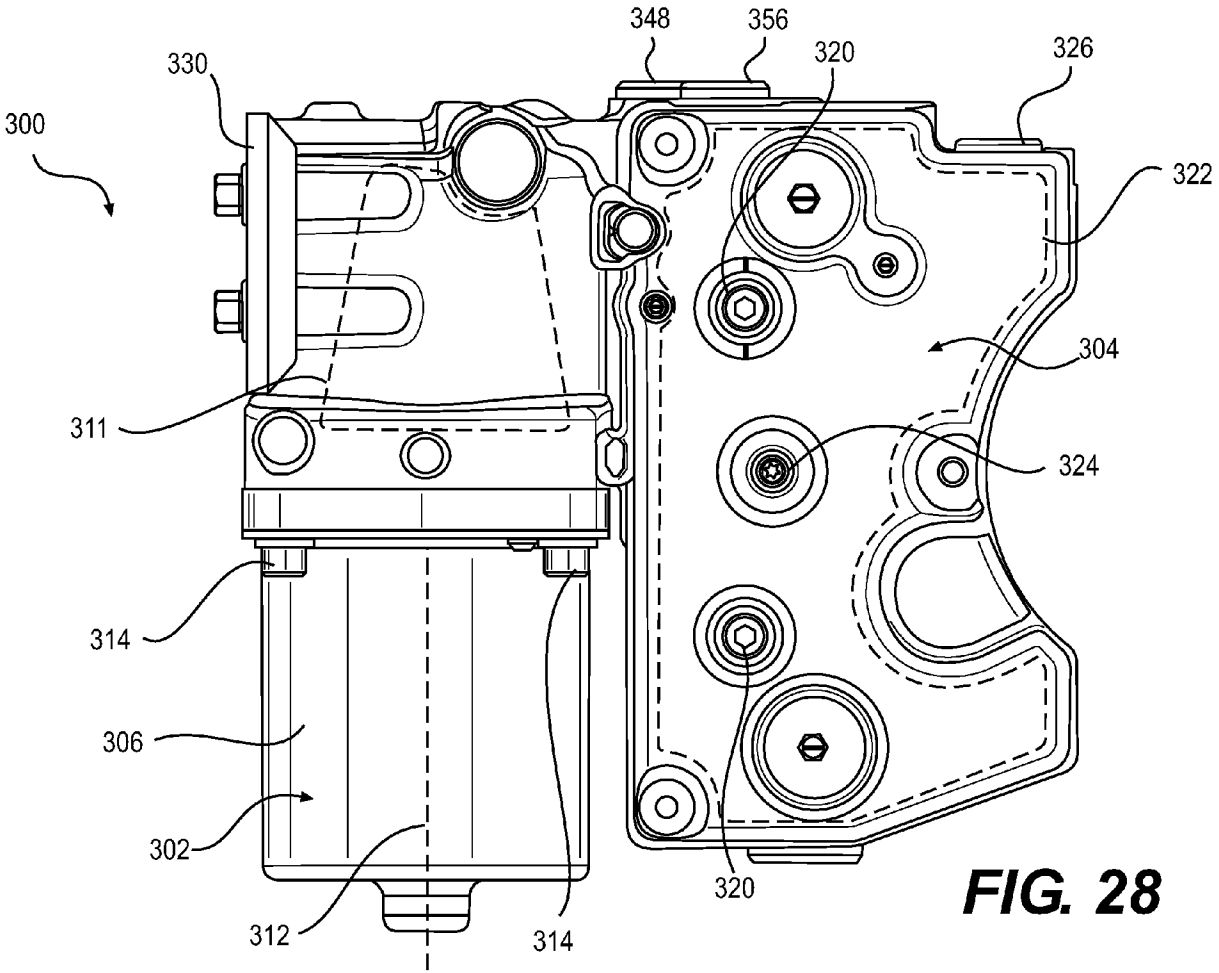
FIG. 28 is a bottom plan view of the hydraulic unit of FIG. 25.
Figure 29:
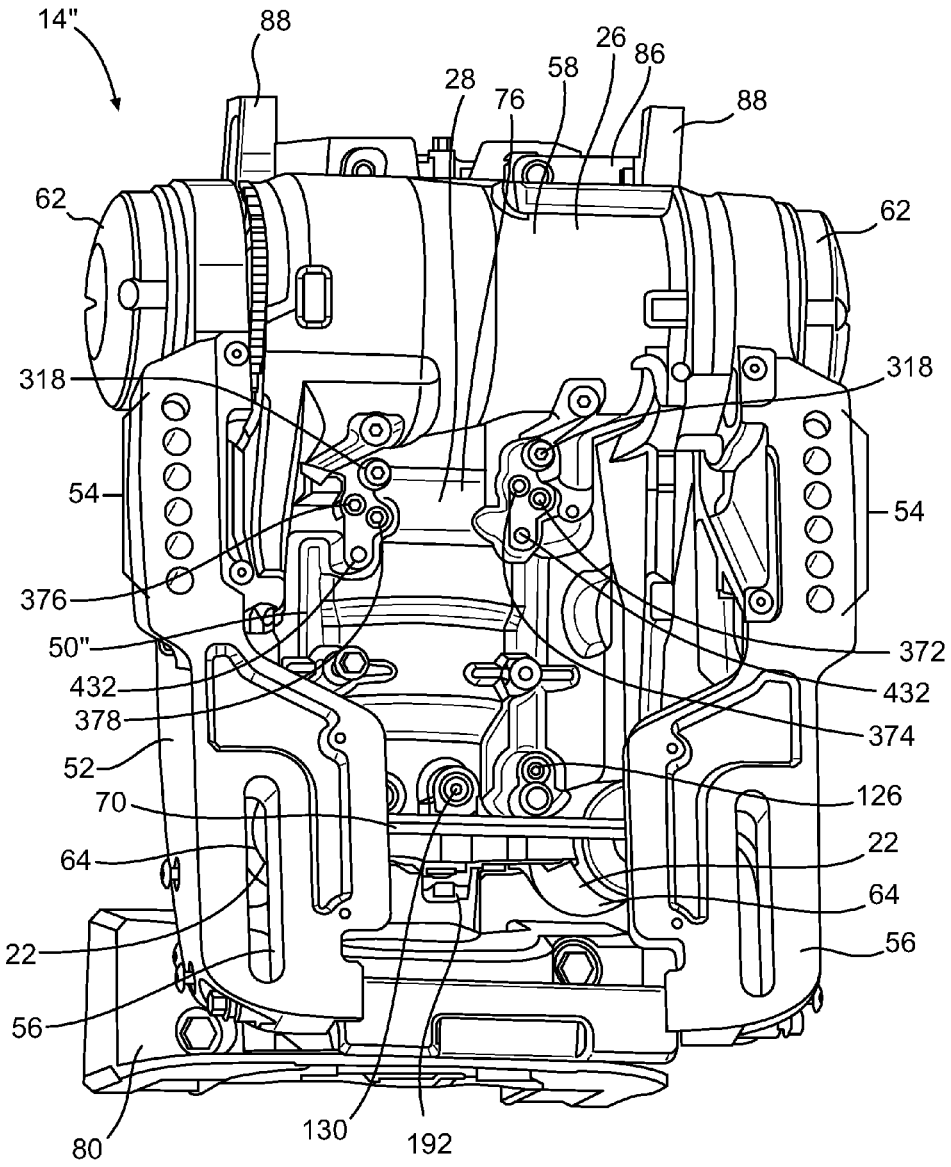
FIG. 29 is a perspective view taken from a front, left side of the bracket assembly of FIG. 25 with the hydraulic units removed.

As can be seen in FIGS. 23 and 24, the hydraulic unit 300 is disposed below the tilt/trim axis 24 and between the drive unit mounting brackets 78, 80. The hydraulic unit 300 is disposed on top of the hydraulic unit 200. The valve unit 304 is fastened to the valve unit 208 by fasteners 320 (FIG. 27).

The valve unit 304 defines a fluid reservoir 322 (shown in dotted lines in FIG. 28) containing hydraulic fluid to be supplied to the valve unit 208 and also adapted to receive hydraulic fluid from the valve unit 208. An aperture (not shown) in the top of the valve unit 208 is aligned with and connected to an aperture 324 (FIG. 28) in the bottom of the valve unit 304. A filter (not shown) disposed inside the valve unit 304 about the aperture 324 filters hydraulic fluid flowing to the valve unit 208.

Figure 25:
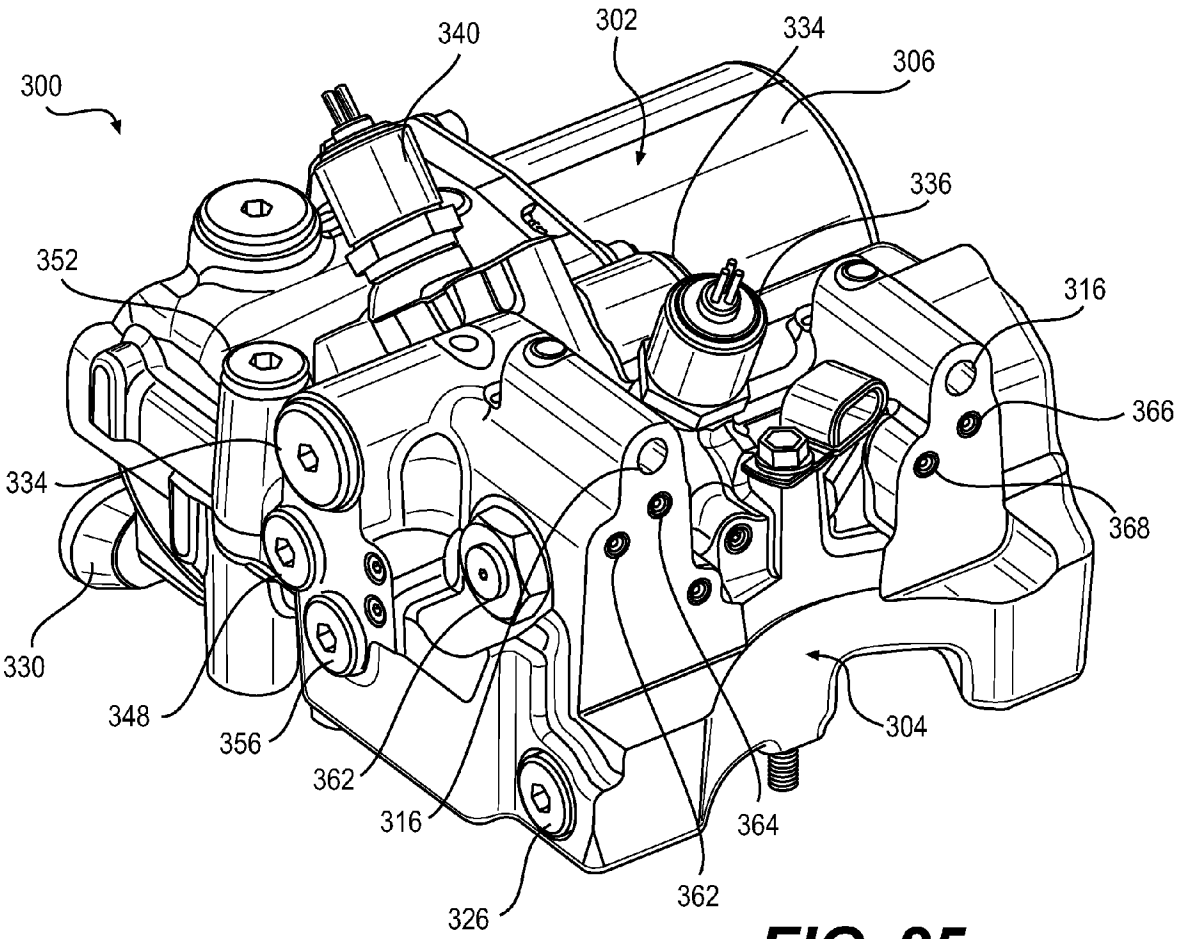
FIG. 25 is a perspective view taken from a rear, left side of a hydraulic unit of the bracket assembly of FIG. 23.
Figure 26:
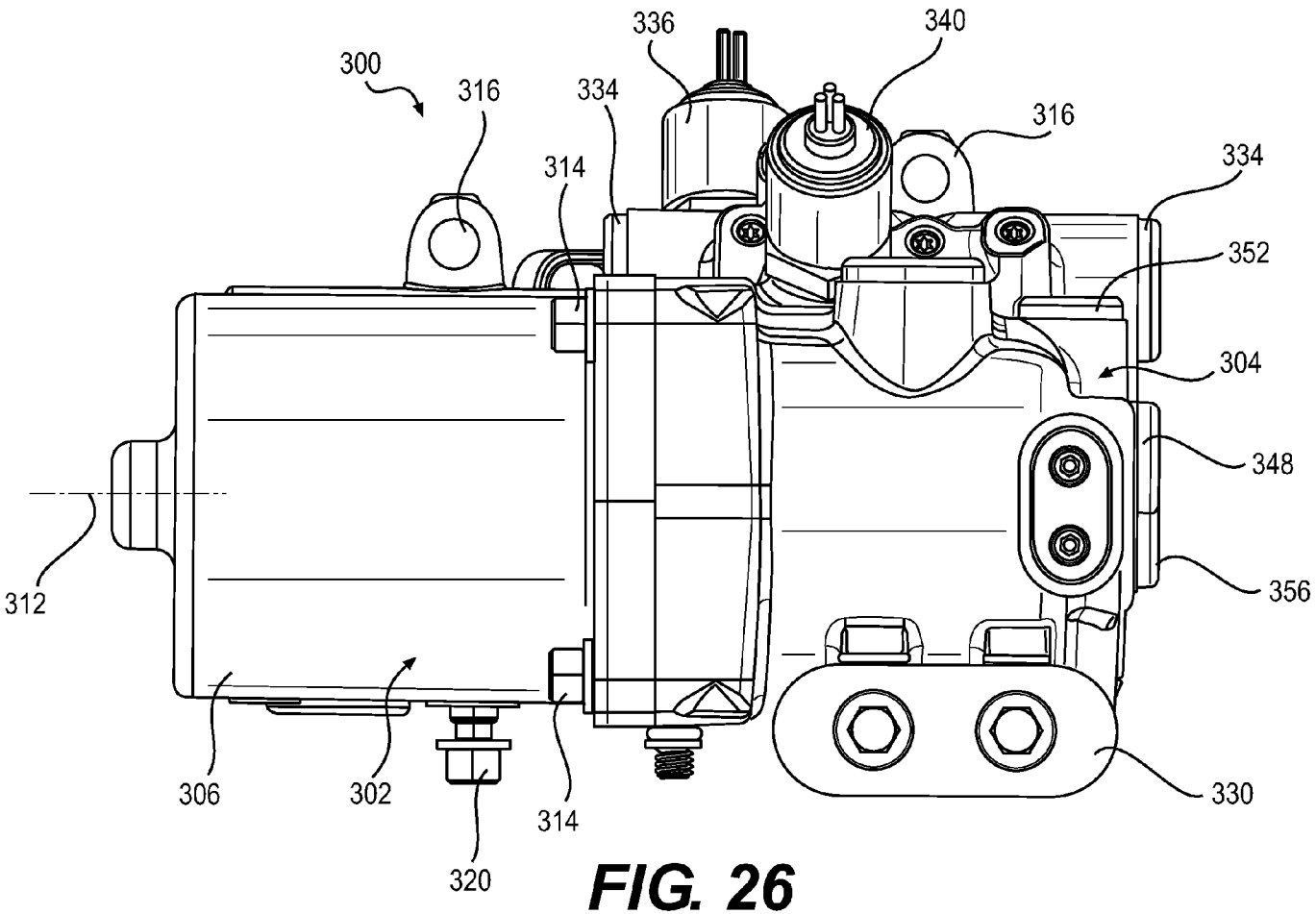
FIG. 26 is a front elevation view of the hydraulic unit of FIG. 25.

Hydraulic fluid can be added to the fluid reservoir 322 via a reservoir inlet closed by a cap 326 (FIG. 25). When the hydraulic unit 300 is mounted to the swivel bracket 50", the reservoir inlet is in alignment with an aperture 328 (FIG. 24) in the side of the swivel bracket 50". As such, the reservoir 322 can be filled without having to remove it from the swivel bracket 50". As can be seen in FIG. 25, the reservoir inlet is located near a bottom of the valve unit 304. To fill the reservoir 322, the swivel bracket 50" is tilted up to its highest position and the cap 326 is removed via the aperture 328. This brings at least a portion of the main volume of the reservoir 322 below the reservoir inlet. Filling the reservoir 322 in this position up to the level of the reservoir inlet ensures that the proper amount of hydraulic fluid is present in the reservoir 322.

As can be seen in FIG. 23, the stern bracket 52 defines a space laterally between its left and right portions. When the swivel bracket 50" is within at least a portion of the range of trim angles, such as in the illustrated upright position, at least a portion of the pumps 102, 302 and the valve units 208, 304 is disposed inside that space.

An anode 330 is fastened to the front of the valve unit 304. The anode 304 helps prevent corrosion of the components of the bracket assembly 14". It is contemplated that the anode 330 could be omitted and/or that one or more anodes 330 could be disposed elsewhere on the bracket assembly 14".

Turning now to FIGS. 25 to 33, additional features of the valve unit 304 will be described.

The pump 302 is fluidly connected to a valve assembly 332 (FIG. 33). The valve assembly 332 includes a passage 333 (FIG. 30) formed within the valve unit 304 that is closed at both ends by caps 334. The valve assembly 332 includes a shuttle 335 disposed in the passage 333. The valve assembly 332 will be described in greater detail below.

A low pressure sensor 336 is connected on top of the valve unit 304 to sense hydraulic fluid pressure upstream of the pump 302. The low pressure sensor 336 is in communication with a control module 338 (FIG. 33). A high pressure sensor 340 is connected on top of the valve unit 304 to sense hydraulic fluid pressure downstream of the pump 302. The high pressure sensor 340 is also in communication with the control module 338. As will be discussed in greater detail below, the control module 338 uses signals received from the pressure sensors 336, 340 to control operation of the pump 302. As is schematically illustrated in FIG. 33, the control module 338 includes a controller 342 and a motor drive 344. The controller 342 receives various signals and determines if and how the pump 302 should be operated. The motor drive 344 consists of one or more circuits that drive the motor 306 based on a signal received from the controller 342 to operate the pump 302 as determined by the controller 342. The control module 338 is part of the drive unit 12 and is disposed inside the cowling 38. It is contemplated that the functions of the control module 338 could be integrated at least in part in the control unit of the engine 36. It is also contemplated that the control module 338 could be housed in or adjacent to the hydraulic unit 300.

A low pressure steering bypass valve 346 (FIG. 33) is located in a passage (not shown) in the valve unit 304 that is closed on a left side of the valve unit 304 by a cap 348. A high pressure blow-off valve 350 (FIG. 33) is located in a passage (not shown) in the valve unit 304 that is closed on a top of the valve unit 304 by a cap 352. A low pressure steering backflow preventer valve 354 (FIG. 33) is located in a passage (not shown) in the valve unit 304 that is closed on a left side of the valve unit 304 by a cap 356. Two actuator valves 358, 360 (FIG. 33) are provided between the valve assembly 332 and the rotary actuator 28. The actuator valves 358, 360 and two passages 426, 430 form a locking valve for preventing inadvertent movement of the rotary actuator 28. A nut 326 provided on the left side of the valve unit 304 can be turned manually to open both actuator valves 358, 360 to unlock the locking valve and permit the drive unit 12 to be turned freely by hand about the steering axis 30, such as when doing maintenance for example. The nut 326 can be accessed via the aperture 139 (FIG. 24) in the swivel bracket 50". The valves 346, 350, 354, 358 and 360 are all one-way, spring-loaded ball valves, also known as check valves, but it is contemplated that other types of one-way valves could be used.

Apertures 362, 364, 366 and 368 (FIG. 25) are defined on a rear side of the valve unit 304 and fluidly communicate with the valve assembly 332 via passages integrally formed in the valve unit 304. When the hydraulic unit 300 is mounted to the swivel bracket 50", the apertures 362, 364, 366 and 368 of the valve unit 304 are in alignment with and adjacent to corresponding apertures 372, 374, 376 and 378 respectively (FIG. 29) defined in the swivel bracket 50". As such, no hydraulic lines need to be connected between the apertures 362, 364, 366 and 368 and the apertures 372, 374, 376 and 378, which simplifies the mounting of the hydraulic unit 300 to the swivel bracket 50". The apertures 372 and 376 fluidly communicate with a hydraulic unit 380 (FIG. 33) driven by the helm assembly 190 of the watercraft, as will be described in greater detail below. The apertures 374 and 378 fluidly communicate with opposite sides of a piston 382 of the rotary actuator 28 via passages integrally formed in the swivel bracket 50" and the main body 76 of the rotary actuator 28.

The hydraulic unit 380 will now be described in greater detail with respect to FIG. 33. The hydraulic unit 380 includes a hydraulic actuator, which in the present implementation is a bi-directional mechanically driven helm pump 384. The helm pump 384 has an inlet port 386 and two other ports 388 and 390. The helm pump 384 is driven by the helm assembly 190 via gears for example. It is contemplated that the helm pump 384 could be driven by a bi-directional electric motor actuated in response to a signal received from a steering position sensor sensing a position of the helm assembly 190. The inlet port 386 of the helm pump 384 is connected to a hydraulic fluid reservoir 392. The port 388 is connected to a one-way valve 394. The one-way valve 394 is connected to one end of a hydraulic line (not shown). The other end of the hydraulic line is connected to a fitting 396 (FIG. 24) on the swivel bracket 50". The fitting 396 is connected to the aperture 372 via a passage integrally formed in the swivel bracket 50". A high pressure blow-off valve 398 is connected between the one-way valve 394 and the passage between the reservoir 392 and the inlet 386 of the helm pump 384. Should the pressure of the hydraulic fluid between the one-way valve 394 and the valve assembly 332 become too high, the high pressure blow-off valve 398 opens and releases the pressure. Similarly, the port 390 is connected to a one-way valve 400. The one-way valve 400 is connected to one end of a hydraulic line (not shown). The other end of the hydraulic line is connected to a fitting 402 (FIG. 24) on the swivel bracket 50". The fitting 402 is connected to the aperture 376 via a passage integrally formed in the swivel bracket 50". A high pressure blow-off valve 404 is connected between the one-way valve 400 and the passage between the reservoir 392 and the inlet 386 of the helm pump 384. Should the pressure of the hydraulic fluid between the one-way valve 400 and the valve assembly 332 become too high, the high pressure blow-off valve 404 opens and releases the pressure. The valves 394, 398, 400 and 404 are all one-way, spring-loaded ball valves, also known as check valves, but it is contemplated that other types of one-way valves could be used.

Figure 30:
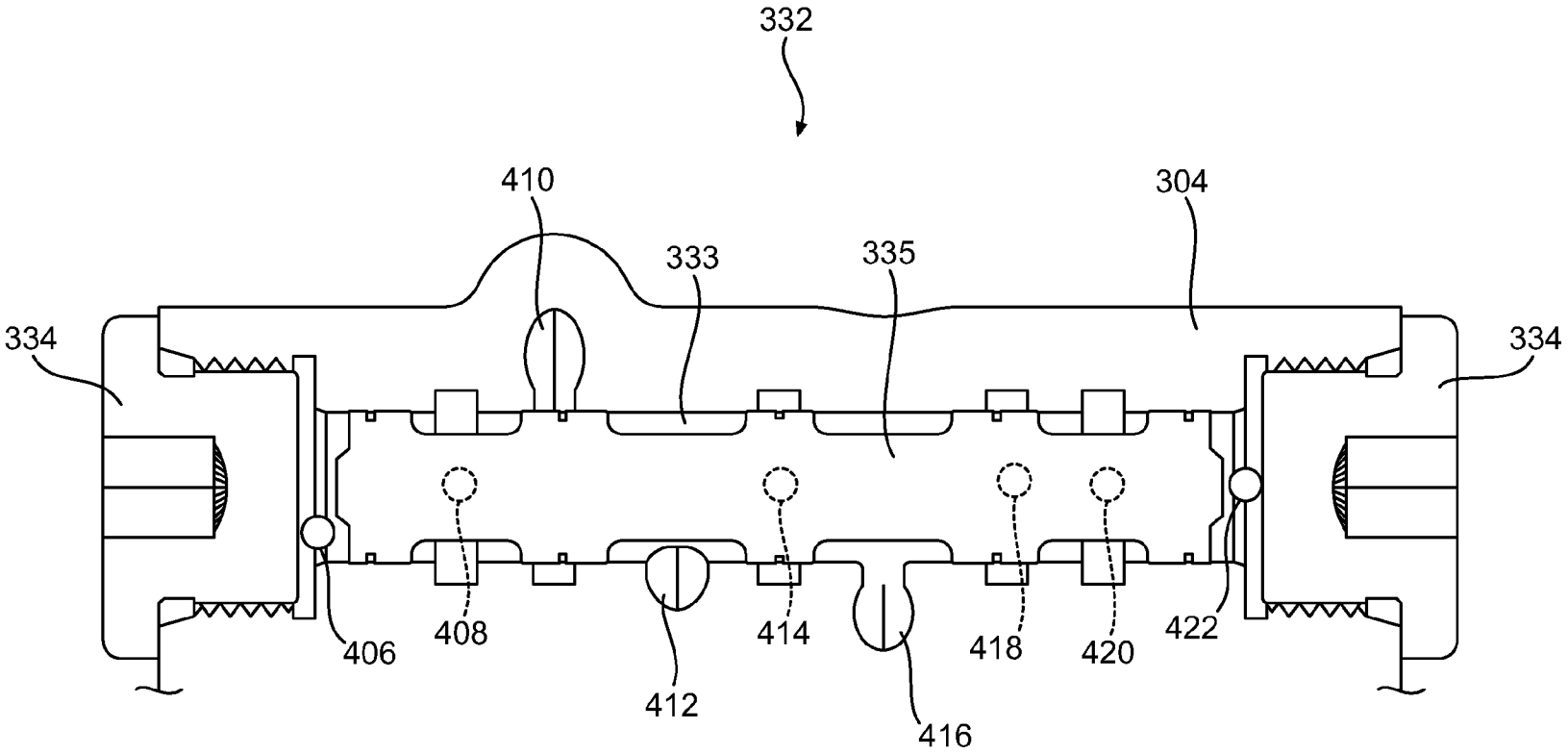
FIG. 30 is a schematic representation of a valve assembly of the hydraulic unit of FIG. 25 in a position corresponding to the drive unit being steered in a straight ahead position.
Figure 31:
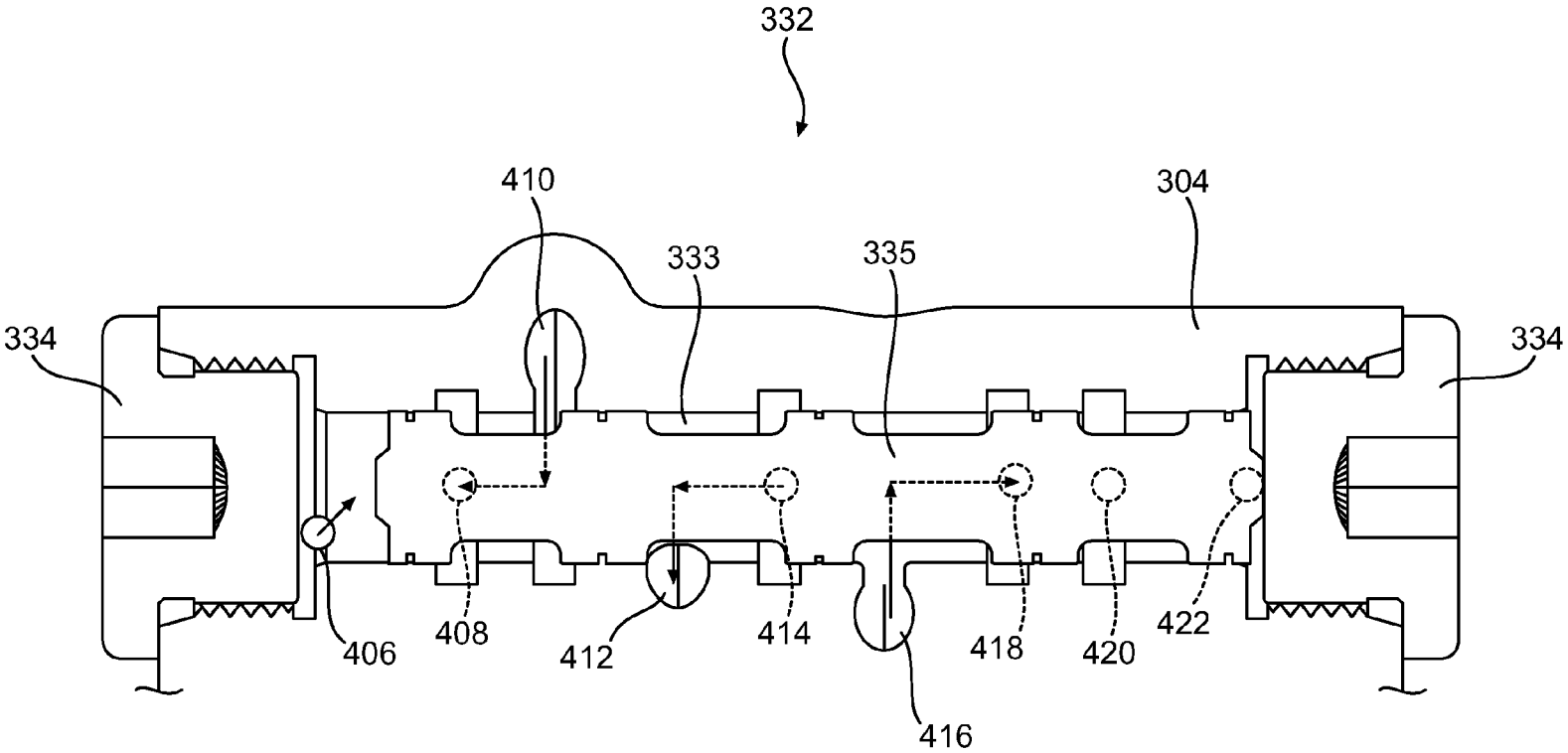
FIG. 31 is a schematic representation of the valve assembly of FIG. 30 in a position corresponding to the drive unit being steered to make a left turn.
Figure 32:
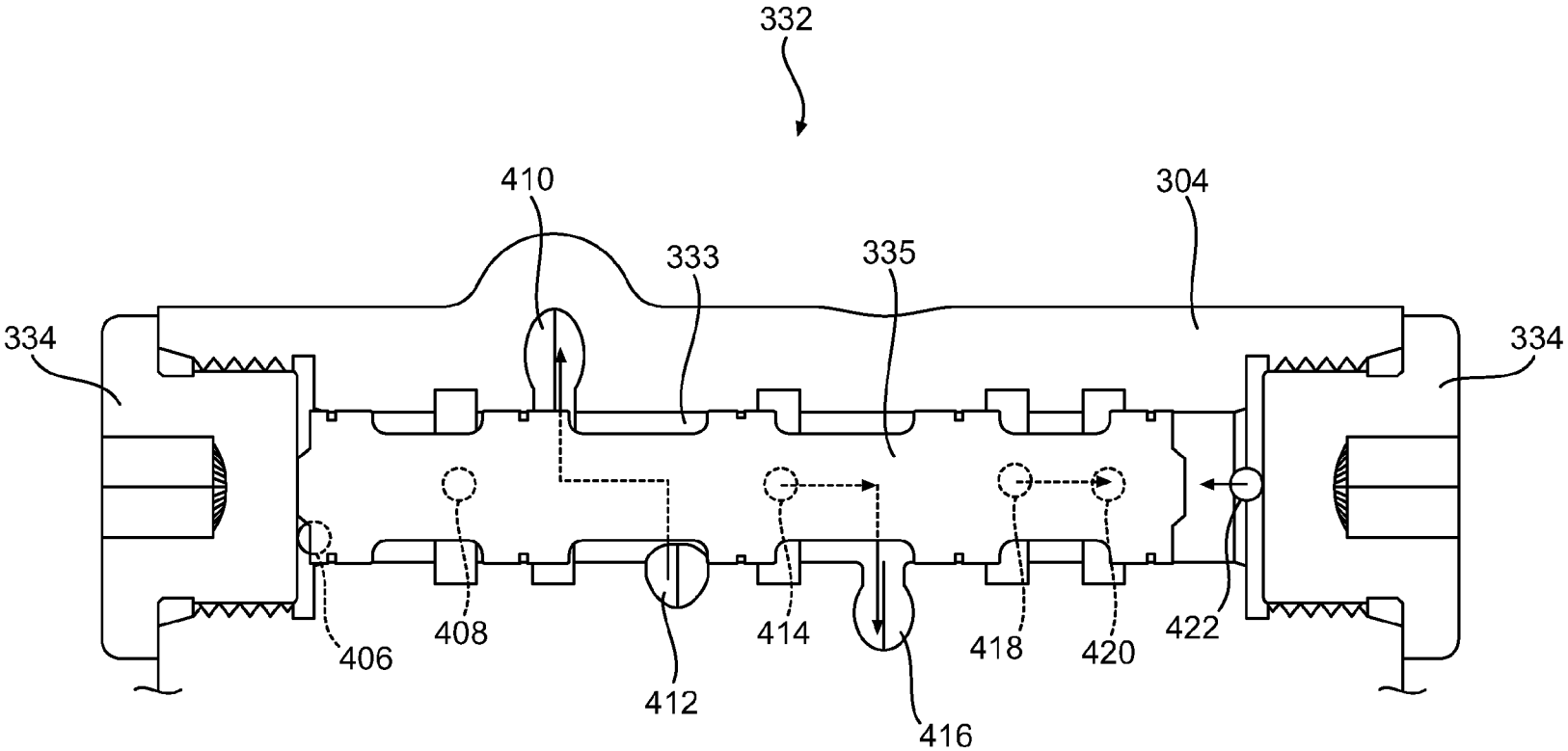
FIG. 32 is a schematic representation of the valve assembly of FIG. 30 in a position corresponding to the drive unit being steered to make a right turn.

Turning now to FIGS. 30 to 32, the valve assembly 332 will be described in more detail. As described above, the valve assembly 332 includes the passage 333 formed by the valve unit 304, closed at both ends by caps 334 and inside which a shuttle 335 is disposed. The valve assembly 332 has a plurality of ports communicating with the passage 333, which, starting on the left side of the passage 333 with respect to FIG. 30, are a shuttle actuation port 406, a pump supply port 408, a helm port 410, an actuator port 412, a pump return port 414, an actuator port 416, a helm port 418, a pump supply port 420, and a shuttle actuation port 422.

As can be seen in FIG. 33, the shuttle actuation port 406 and the helm port 410 are connected to the aperture 362 by a passage integrally formed in the valve unit 304. The shuttle actuation port 422 and the helm port 418 are connected to the aperture 366 by a passage integrally formed in the valve unit 304. The pump supply ports 408 and 420 are connected to an inlet of the pump 302 by a passage integrally formed in the valve unit 304. The actuator port 412 is connected to the aperture 364 by a passage formed in the valve unit 304. The aperture 364 is aligned with the corresponding aperture 374 in the swivel bracket 50", which fluidly communicates with the rotary actuator 28 above the piston 382. The actuator port 416 is connected to the aperture 368 by a passage formed in the valve unit 304. The aperture 368 is aligned with the corresponding aperture 378 in the swivel bracket 50", which fluidly communicates with the rotary actuator 28 below the piston 382. The pump return port 414 is connected to the outlet of the pump 302 by a passage formed in the valve unit 304. As will be explained below, the position of the shuttle 335 selectively communicates some of the ports 408, 410, 412, 414, 416, 418 and 420 with each other. When the helm assembly 190 is steered in a straight ahead position, the shuttle 335 is positioned as shown in FIG. 30. As can be seen in FIG. 30, in this position the ports 406 and 422 are each disposed between an end of the shuttle 335 and a corresponding one of the caps 334 and none of the ports 408, 410, 412, 414, 416, 418 and 420 fluidly communicate with each other. The position of the shuttle valve 335 when the helm assembly 190 is steered left or right and the resulting fluid communications between some of the ports 408, 410, 412, 414, 416, 418 and 420 will be discussed in greater detail below.

With respect to FIG. 33, the general operation of the hydraulic steering system will be described. When the driver of the watercraft turns the helm assembly 190 to turn left or right (port or starboard), the hydraulic unit 380 supplies hydraulic fluid to the valve assembly 332, which routes hydraulic fluid to and from the pump 302 and the rotary actuator 28 as will be described in more detail below. From the valve assembly 332, the hydraulic fluid is supplied upstream of the pump 302. The low pressure sensor 336 senses the pressure of the hydraulic fluid upstream of the pump 302 and sends a signal representative of this pressure to the control module 338.

If the pressure of the hydraulic fluid upstream of the pump 302 is less than a first predetermined pressure, 50 psi for example, the control module 338 causes the motor 306 to stop and thereby causes the pump 302 to stop operating. This could occur for example if the helm assembly is turned slowly or if the watercraft is moving slowly. When the pump 302 stops, the hydraulic pressure in the passage upstream of the pump 302 causes the low pressure steering bypass valve 346 to open and hydraulic fluid flows from the valve assembly 332, through the valve 346, thereby bypassing the pump 302, and back to the valve assembly 332. The low pressure steering backflow preventer valve 354 prevents hydraulic fluid from flowing back into the pump 302 via the outlet of the pump 302.

If the pressure of the hydraulic fluid upstream of the pump 302 is greater than or equal to the first predetermined pressure, the control module 338 causes the motor 306 to run and thereby causes the pump 302 to operate. The pump 302 pressurizes the hydraulic fluid, causes it to flow through the steering backflow preventer valve 354 and then to the valve assembly 332 via the pump return port 414. The pressure of the hydraulic fluid flowing from the pump 302 to the valve assembly 332 causes the low pressure steering bypass valve 346 to be closed. The high pressure sensor 340 senses the pressure of the hydraulic fluid flowing from the pump 302 to the valve assembly 332 and sends a signal representative of this pressure to the control module 338. The speed at which the control module 338 causes the motor 306 to run, and thereby regulates the operation of the pump 302, is determined at least in part by the hydraulic fluid pressure sensed by the pressure sensors 336, 340. It is contemplated that the control module 338 could also regulate the operation of the pump 302 as a function of one or more operational characteristics of the watercraft and the outboard engine 12 such as, for example, watercraft speed, throttle request and engine speed. The information regarding the one or more operational characteristics is received by the control module 338 via one or more signals from the control unit of the outboard engine 12. If the pressure of the hydraulic fluid sensed by the high pressure sensor 340 is above a second predetermined pressure, 1700 psi for example, the control module 338 causes the motor 306 to stop and thereby causes the pump 302 to stop operating in order to prevent the high pressure to damage the pump 302, the valve unit 304 and the other hydraulic components. A second layer of protection is provided by the high pressure blow-off valve 350. Should the pressure of the hydraulic fluid in the passage between the pump 302 and the valve assembly 332 continue to rise above the second predetermined pressure, the high pressure blow-off valve 350 opens when the pressure of the hydraulic fluid reaches a third predetermined pressure, 1800 psi for example, to help stopping the pressure to increase further and then decrease. It is contemplated that the first, second and third predetermined pressures could have values that differ from those provided in the above examples.

From the valve assembly 332, the hydraulic fluid received via the valve 346 or from the pump 302, as the case may be, is supplied to the rotary actuator 28. If the helm assembly 190 has been turned to make a left turn, the hydraulic fluid is supplied from the valve assembly 332 to the rotary actuator 28 above the piston 382, causing the piston 382 to move down, and thereby causing the drive unit 12 to be steered to make a left turn, as in FIG. 6. Hydraulic fluid under the piston 382 is pushed out of the rotary actuator 28 by the piston 382 and is returned to the hydraulic unit 380 via the valve assembly 332. If the helm assembly 190 has been turned to make a right turn, the hydraulic fluid is supplied from the valve assembly 332 to the rotary actuator 28 below the piston 382, causing the piston 382 to move up, and thereby causing the drive unit 12 to be steered to make a right turn. Hydraulic fluid above the piston 382 is pushed out of the rotary actuator 28 by the piston 382 and is returned to the hydraulic unit 380 via the valve assembly 332.

The operation of the hydraulic steering system to make a left turn and a right turn will now be explained in more detail with respect to FIGS. 31 to 33. The following explanation assumes that the pressure of the hydraulic fluid sensed by the low pressure sensor 336 is above the first predetermined pressure and that the pressure of the hydraulic fluid sensed by the high pressure sensor 340 is below the second predetermined pressure, and as such the pump 302 is in operation.

The operation of the hydraulic steering system to make a left turn will now be explained in more detail with respect to FIGS. 31 and 33. When the helm 190 is steered to make a left turn, the helm pump 384 expels hydraulic fluid from its port 388, drawing that hydraulic fluid from one or both of the reservoir 392 (via the inlet port 386) and the port 390. The hydraulic fluid expelled from the port 388 causes the one-way valve 394 to open and flows through the valve 394. The hydraulic fluid expelled from the port 388 also causes the one-way valve 400 to open via a passage 424, thereby allowing hydraulic fluid to be returned to the port 390 of the helm pump 384 from the aperture 376 of the swivel bracket 50" as will be discussed below. From the one-way valve 394, the hydraulic fluid flows through the aperture 372 of the swivel bracket 50" and then through the aperture 362 of the valve unit 304.

The aperture 362 is hydraulically linked with the shuttle actuation port 406 of the valve assembly 332 and the pumped hydraulic fluid will therefore cause the shuttle 335 to move toward the right with respect to the orientation of the valve assembly 332 in FIG. 31. The shuttle 335 will remain this position as long as the helm pump 384 continues to push hydraulic fluid out of the port 388 and towards the aperture 362. This movement of the shuttle 335 towards the right causes hydraulic fluid contained between the right end of the shuttle 335 and the right cap 334 (with respect to the orientation of FIG. 31) to be expelled through the shuttle actuation port 422 and flow toward the aperture 366 in the valve unit 304. When the shuttle 335 has reached the position seen in FIG. 31, the valve assembly 332 fluidly connects the helm port 410 with the pump supply port 408, the pump return port 414 with the actuator port 412, and the actuator port 416 with the helm port 418. When the shuttle 335 is in the position shown in FIG. 31, the pump supply port 420 is blocked and does not communicate with any of the other ports 408, 410, 412, 414, 416 and 418.

With the shuttle 335 having reached the position shown in FIG. 31, the hydraulic fluid flows from the aperture 362 into the valve assembly 332 via the helm port 410 and then flows out of the valve assembly 332 via the pump supply port 408. Returning to FIG. 33, from the pump supply port 408, the hydraulic fluid flows to the inlet of the pumping member 310 of the pump 302 and is expelled from the outlet of the pumping member 310. From the outlet of the pumping member 310, the hydraulic fluid causes the low pressure steering backflow preventer valve 354 to open and flows through the valve 354. From the valve 354, the hydraulic fluid flows into the valve assembly 332 via the pump return port 414 and then flows out of the valve assembly 332 via the actuator port 412 (see FIG. 31).

Figure 6:
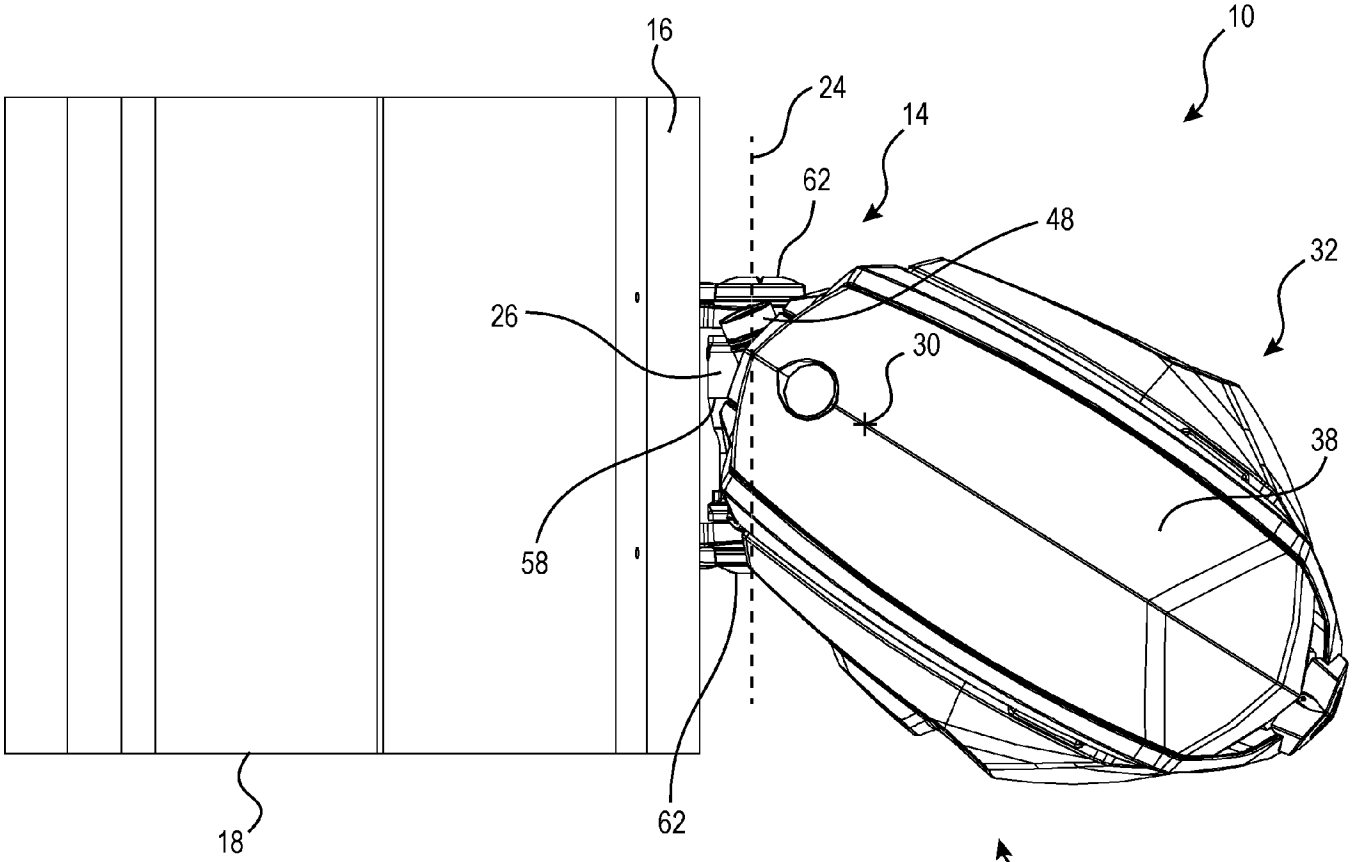
FIG. 6 is a top plan view of the outboard engine of FIG. 1 steered to make a left turn.

The hydraulic fluid that flows out of the actuator port 412 causes the actuator valve 358 to open and to fluidly connect the actuator port 412 with the rotary actuator 28. The hydraulic fluid flowing out of the actuator port 412 also causes the actuator valve 360 to open via the passage 426, thereby allowing hydraulic fluid to be returned to the valve assembly 332 from the aperture 368 of the valve unit 304 as will be discussed below. From the actuator valve 358, the hydraulic fluid flows through the aperture 364 of the valve unit 304 and then through the aperture 374 of the swivel bracket 50". From the aperture 374, the hydraulic fluid flows into the rotary actuator 28 above the piston 382. As a result, the piston 382 moves down which causes the drive unit 12 to pivot about the steering axis 30 to make the watercraft turn left, as shown in FIG. 6.

As a result of the piston 382 moving down, hydraulic fluid present in the rotary actuator 28 below the piston 382 flows out of the rotary actuator 28, through the aperture 378 of the swivel bracket 50" and then through the aperture 368 of the valve unit 304. From the aperture 368, the hydraulic fluid can flow through the opened actuator valve 360. From the actuator valve 360, the hydraulic fluid can flow into the valve assembly 332 via the actuator port 416 and then out of the valve assembly 332 via the helm port 418 (see FIG. 31).

From the helm port 418, the hydraulic fluid flows through the aperture 366 of the valve unit 304 and then through the aperture 376 of the swivel bracket 50". From the aperture 376, the hydraulic fluid flows through the opened one-way valve 400 and then back to the helm pump 384 via the port 390 of.

The operation of the hydraulic steering system to make a right turn will now be explained in more detail with respect to FIGS. 32 and 33. When the helm 190 is steered to make a right turn, the helm pump 384 expels hydraulic fluid from its port 390, drawing that hydraulic fluid from one or both of the reservoir 392 (via the inlet port 386) and the port 388. The hydraulic fluid expelled from the port 390 causes the one-way valve 400 to open and flows through the valve 400. The hydraulic fluid expelled from the port 390 also causes the one-way valve 394 to open via a passage 428, thereby allowing hydraulic fluid to be returned to the port 388 of the helm pump 384 from the aperture 372 of the swivel bracket 50" as will be discussed below. From the one-way valve 400, the hydraulic fluid flows through the aperture 376 of the swivel bracket 50" and then through the aperture 366 of the valve unit 304.

The aperture 366 is hydraulically linked with the shuttle actuation port 422 of the valve assembly 332 and the pumped hydraulic fluid will therefore cause the shuttle 335 to move toward the left with respect to the orientation of the valve assembly 332 in FIG. 32. The shuttle 335 will remain in this position as long as the helm pump 364 continues to push hydraulic fluid out of the port 390 and towards the aperture 366. This movement of the shuttle 335 towards the position shown in FIG. 32 causes hydraulic fluid contained between the left end of the shuttle 335 and the left cap 334 (with respect to the orientation of FIG. 32) to be expelled through the shuttle actuation port 406 and flow toward the aperture 362 in the valve unit 304. When the shuttle 335 has reached the position seen in FIG. 32, the valve assembly 332 fluidly connects the helm port 418 with the pump supply port 420, the pump return port 414 with the actuator port 416, and the actuator port 412 with the helm port 410. When the shuttle 335 is in the position shown in FIG. 32, the pump supply port 408 does not communicate with any of the other ports 410, 412, 414, 416, 418 and 420.

With the shuttle 335 having reached the position shown in FIG. 32, the hydraulic fluid flows from the aperture 366 into the valve assembly 332 via the helm port 418 and then flows out of the valve assembly 332 via the pump supply port 420. Returning to FIG. 33, from the pump supply port 420, the hydraulic fluid flows to the inlet of the pumping member 310 of the pump 302 and is expelled from the outlet of the pumping member 310. From the outlet of the pumping member 310, the hydraulic fluid causes the low pressure steering backflow preventer valve 354 to open and flows through the valve 354. From the valve 354, the hydraulic fluid flows into the valve assembly 332 via the pump return port 414 and then flows out of the valve assembly 332 via the actuator port 416 (see FIG. 32).

The hydraulic fluid that flows out of the actuator port 416 causes the actuator valve 360 to open and to fluidly connect the actuator port 416 with the rotary actuator 28. The hydraulic fluid flowing out of the actuator port 416 also causes the actuator valve 358 to open via the passage 430, thereby allowing hydraulic fluid to be returned to the valve assembly 332 from the aperture 364 of the valve unit 304 as will be discussed below. From the actuator valve 360, the hydraulic fluid flows through the aperture 368 of the valve unit 304 and then through the aperture 378 of the swivel bracket 50". From the aperture 378, the hydraulic fluid flows into the rotary actuator 28 below the piston 382. As a result, the piston 382 moves up which causes the drive unit 12 to pivot about the steering axis 30 to make the watercraft turn right.

As a result of the piston 382 moving up, hydraulic fluid present in the rotary actuator 28 above the piston 382 flows out of the rotary actuator 28, through the aperture 374 of the swivel bracket 50" and then through the aperture 364 of the valve unit 304. From the aperture 364, the hydraulic fluid can flow through the opened actuator valve 358. From the actuator valve 358, the hydraulic fluid can flow into the valve assembly 332 via the actuator port 412 and then out of the valve assembly 332 via the helm port 410 (see FIG. 32).

From the helm port 410, the hydraulic fluid flows through the aperture 362 of the valve unit 304 and then through the aperture 372 of the swivel bracket 50". From the aperture 372, the hydraulic fluid flows through the opened one-way valve 394 and then back to the helm pump 384 via the port 388.

It is contemplated the hydraulic unit 300 could be omitted. In such an implementation, the reservoir 210 is provided on the hydraulic unit 200. Also, a left fitting (not shown) is connected to the swivel bracket 50" by fasteners inserted into the aperture 318 above the apertures 372, 374 and into the aperture 432 below the apertures 372, 374 (see FIG. 29). Similarly, a right fitting (not shown) is connected to the swivel bracket 50" by fasteners inserted into the aperture 318 above the apertures 376, 378 and into the aperture 432 below the apertures 376, 378. The left fitting defines a passage that fluidly communicates the aperture 372 with the aperture 374 and the right fitting defines a passage that fluidly communicates the aperture 376 with the aperture 378. As a result, when the helm assembly 190 is steered to make a left turn, hydraulic fluid flows from the helm pump 384, through the aperture 372, through the left fitting, through the aperture 374 and into the rotary actuator 28 above the piston 382, and hydraulic fluid flows from below the piston 382 in the rotary actuator 28, through the aperture 378, through the right fitting, through the aperture 376 and back to the helm pump 384. When the helm assembly 190 is steered to make a right turn, hydraulic fluid flows from the helm pump 384, through the aperture 376, through the right fitting, through the aperture 378 and into the rotary actuator 28 below the piston 382, and hydraulic fluid flows from above the piston 382 in the rotary actuator 28, through the aperture 374, through the left fitting, through the aperture 372 and back to the helm pump 384.

Turning back to FIG. 24, additional features of the bracket assembly 14" will now be described.

The swivel bracket 50" has two bleeder valves 434 installed thereon. The bleeder valves 434 fluidly communicate with passages in the swivel bracket 50" that fluidly communicate with the hydraulic unit 300 and the hydraulic unit 380. The bleeder valves 434 are opened when the hydraulic fluid reservoirs 311, 392 are being filled in order to allow air to escape from the hydraulic system.

The swivel bracket 50" also has two liquid tie bar passages on the left side of the rotary actuator closed by plugs 436, 438 and one liquid tie bar passage on the right side of the rotary actuator 28 closed by a plug (not shown but generally indicated by arrow 440). When multiple outboard engines 10 are mounted to a transom of the watercraft 16, the liquid tie bar passages provide an alternative to connecting rods between linkages 86 of the outboard engines 10 in order to permit simultaneous steering of all the drive units 12 using only one hydraulic unit 300. When multiple outboard engines 10 are mounted to a transom of the watercraft 16, the plugs 436, 440 are replaced with fittings (not shown) similar to the fittings 396, 402 and are connected to corresponding fittings on another outboard engine 10 via hydraulic lines (not shown) and the plug 438 is replaced by a plug (not shown) defining passages that modify the flow of hydraulic fluid inside the swivel bracket 50". As a result, when hydraulic fluid is supplied to the rotary actuator 28 of the outboard engine having the hydraulic unit 300 to steer the drive unit 12, hydraulic fluid is supplied to the rotary actuator 28 of another outboard engine 10 not provided with a hydraulic unit 200 via the liquid tie bar passages in order to steer the other drive unit 12 in the same direction.

Figure 34:
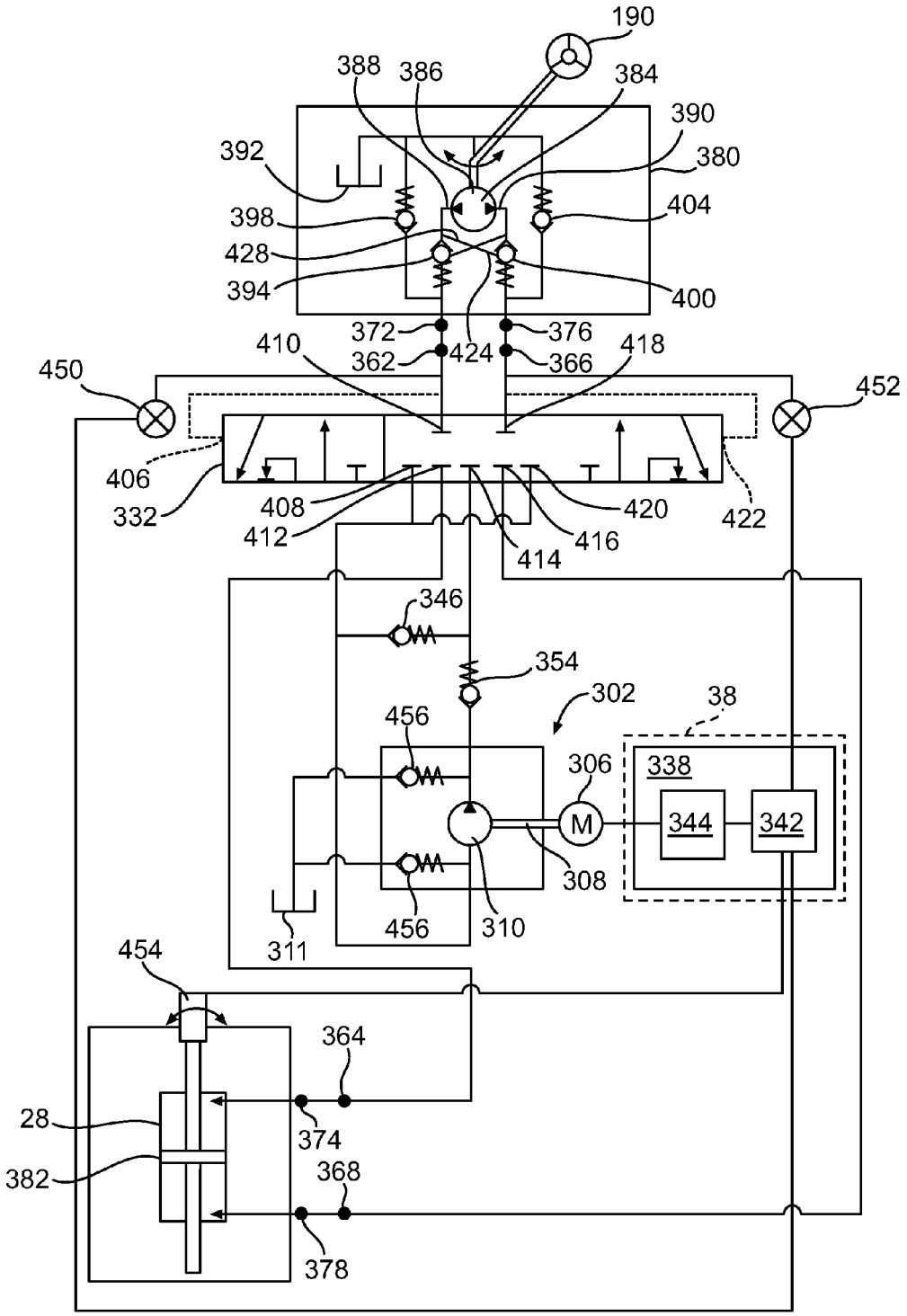
FIG. 34 is a hydraulic circuit diagram of an alternative implementation of the hydraulic unit of FIG. 25.

Turning now to FIG. 34, a hydraulic circuit of an alternative implementation of the hydraulic unit 300 will be described. Features of the hydraulic circuit of FIG. 34 that are similar to those illustrated in the hydraulic circuit of FIG. 33 have been labeled with the same reference numerals and will not be described again herein.

In the alternative implementation of the hydraulic unit 300 shown in FIG. 34, the high pressure blow-off valve 350 and the locking valve formed by the actuator valves 350, 358 and the passages 358, 360 have been omitted.

Also in the alternative implementation of the hydraulic unit 300 shown in FIG. 34, the pressure sensors 336 and 340 have been replaced with pressure sensors 450, 452. As can be seen in FIG. 34, the pressure sensor 450 is positioned to sense the hydraulic pressure in the passage defined in the hydraulic unit 300 between the aperture 362 and the helm port 410. It is contemplated that the pressure sensor 450 could be positioned to sense the pressure anywhere between the valve 394 and the helm port 410. The pressure sensor 450 sends a signal representative of the sensed pressure to the controller 342. The pressure sensor 452 is positioned to sense the hydraulic pressure in the passage defined in the hydraulic unit 300 between the aperture 366 and the helm port 418. During operation, one of the pressure sensors 450, 452 senses the hydraulic pressure of hydraulic fluid flowing into the valve unit 304 from the hydraulic unit 380, while the other of the pressure sensors 450, 452 senses the hydraulic pressure of hydraulic fluid flowing out of the valve unit 304 to the hydraulic unit 380. The direction of flow of hydraulic fluid being sensed by the pressure sensors 450, 452 depends on the direction or rotation of the helm assembly 190. It is contemplated that the pressure sensor 452 could be positioned to sense the pressure anywhere between the valve 400 and the helm port 418. The pressure sensor 452 sends a signal representative of the sensed pressure to the controller 342.

The speed at which the control module 338 causes the motor 306 to run, and thereby regulates the operation of the pump 302, is determined at least in part by the hydraulic fluid pressure sensed by the pressure sensors 450, 452. If the difference between the pressures of the hydraulic fluid sensed by the pressure sensors 450, 452 are above a predetermined value, 6 psi for example, the control module 338 causes the motor 306 to run.

As can be seen in FIG. 34, a steering position sensor 454 is provided on top of the rotary actuator 28. In the present implementation, the steering position sensor 454 is a magnetic rotary position sensor, but other types of sensors are also contemplated. The steering position sensor 454 senses the angular position of the drive unit 12 about the steering axis 30 and sends a signal representative of this position to the controller 342. The control module 338 causes the motor 306 to stop operating when the angular position of the drive unit 12 about the steering axis 30 corresponds to the maximum steering position (left or right) of the drive unit 12. It is contemplated that steering position sensors could be provided in the above described implementations to control the steering operation. It is also contemplated that tilt/trim position sensors could be provided to similarly control the tilting and trimming operation.

Two one-way valves 456 are provided inside the pump 302 in the passages connecting the fluid reservoir 311 to the pumping member 310. The valves 456 ensure that fluid only flows from the reservoir 311 to the pumping member 310 in these passages. It is contemplated that the valves 456 could also be provided in the pump 302 of the implementation of FIG. 33.

Modifications and improvements to the above-described implementations of the present technology may become apparent to those skilled in the art. The foregoing description is intended to be exemplary rather than limiting. The scope of the present technology is therefore intended to be limited solely by the scope of the appended claims.

What is claimed is:

1. A marine outboard engine for a watercraft comprising:

a stern bracket for mounting the marine outboard engine to the watercraft;

a swivel bracket pivotally connected to the stern bracket about a generally horizontal tilt/trim axis;

a drive unit pivotally connected to the swivel bracket about a steering axis, the steering axis being generally perpendicular to the tilt/trim axis;

a hydraulic actuator operatively connected to the drive unit and the swivel bracket for pivoting the drive unit relative to the swivel bracket about the steering axis; and a pump mounted to the swivel bracket, the pump being pivotable about the tilt/trim axis together with the swivel bracket, the pump being fluidly connected to the hydraulic actuator to supply hydraulic fluid to the hydraulic actuator.

2. The marine outboard engine of claim 1, wherein the pump is a first pump and the hydraulic actuator is a first hydraulic actuator;

the marine outboard engine further comprising:

a second hydraulic actuator operatively connected to the stern bracket and the swivel bracket for pivoting the swivel bracket and the drive unit relative to the stern bracket about the tilt/trim axis; and a second pump mounted to the swivel bracket, the second pump being pivotable about the tilt/trim axis together with the swivel bracket, the second pump being fluidly connected to the second hydraulic actuator to supply hydraulic fluid to the second hydraulic actuator.

3. The marine outboard engine of claim 2, wherein the first pump is disposed between the tilt/trim axis and the second pump.

4. The marine outboard engine of claim 3, wherein the first hydraulic actuator has first and second ports, the first pump supplying hydraulic fluid to the first port to pivot the drive unit in a first direction about the steering axis, the first pump supplying hydraulic fluid to the second port to pivot the drive unit in a second direction about the steering axis; and the marine outboard engine further comprising a valve unit containing at least one valve, a position of the at least one valve determining the one of the first and second ports that is supplied with hydraulic fluid from the first pump, the valve unit being mounted to the swivel bracket, and the first pump being mounted to the valve unit, the valve unit defining a fluid reservoir for containing hydraulic fluid, the reservoir being fluidly connected to the second pump.

5. The marine outboard engine of claim 2, wherein the first and second hydraulic actuators are first and second rotary hydraulic actuators.

6. The marine outboard engine of claim 2, further comprising a third hydraulic actuator, the third hydraulic actuator being a linear hydraulic actuator mounted to the swivel bracket between the swivel bracket and the stern bracket, the second pump being fluidly connected to the linear hydraulic actuator to supply hydraulic fluid to the linear hydraulic actuator, the linear hydraulic actuator being adapted to push the swivel bracket away from the stern bracket to pivot the swivel bracket and the drive unit away from the stern bracket about the tilt/trim axis up to a first angle; and wherein the second hydraulic actuator is adapted to pivot the swivel bracket and the drive unit relative to the stern bracket about the tilt/trim axis up to a second angle, the second angle being greater than the first angle.

7. The marine outboard engine of claim 6, wherein the first pump is disposed between the tilt/trim axis and the linear hydraulic actuator.

8. The marine outboard engine of claim 1, wherein the hydraulic actuator has first and second ports, the pump supplying hydraulic fluid to the first port to pivot the drive unit in a first direction about the steering axis, the pump supplying hydraulic fluid to the second port to pivot the drive unit in a second direction about the steering axis; and the marine outboard engine further comprising a valve unit containing at least one valve, a position of the at least one valve determining the one of the first and second ports that is supplied with hydraulic fluid from the pump, the valve unit being mounted to the swivel bracket, and the pump being mounted to the valve unit.

9. The marine outboard engine of claim 8, wherein:

the at least one valve has a third port, a fourth port, and a fifth port;

the pump is fluidly connected to the third port and supplies hydraulic fluid to the third port;

the fourth port is fluidly connected to the first port;

the fifth port is fluidly connected to the second port;

in a first position of the at least one valve, the third port is fluidly connected to the fourth port, the third port is fluidly disconnected from the fifth port and the pump supplies hydraulic fluid to the first port via the at least one valve; and in a second position of the at least one valve, the third port is fluidly connected to the fifth port, the third port is fluidly disconnected from the fourth port and the pump supplies hydraulic fluid to the second port via the at least one valve.

10. The marine outboard engine of claim 8, wherein the pump is an electric pump;

wherein the valve unit includes at least one pressure sensor sensing hydraulic pressure of hydraulic fluid in the valve unit;

the marine outboard engine further comprising a control module communicating with the pump to control operation of the pump, the control module controlling the pump based at least in part on a signal from the at least one pressure sensor.

11. The marine outboard engine of claim 10, wherein the drive unit includes the control module.

12. The marine outboard engine of claim 10, wherein:

the hydraulic actuator is a first hydraulic actuator;

the pump is adapted to receive hydraulic fluid from a second hydraulic actuator via the valve unit, the second hydraulic actuator being driven by a helm of the watercraft;

the pump supplies the hydraulic fluid received from the second hydraulic actuator via the valve unit to the first hydraulic actuator;

the at least one pressure sensor includes a first pressure sensor and a second pressure sensor;

one of the first and second pressure sensors senses a hydraulic pressure of hydraulic fluid flowing from the second hydraulic actuator to the valve unit;

another of the first and second pressure sensors senses a hydraulic pressure of hydraulic fluid flowing from the valve unit to the second hydraulic actuator;

the control module causes the pump to operate when a difference between the hydraulic pressure sensed by the first pressure sensor and the hydraulic pressure sensed by the second pressure sensor is above a predetermined value; and the control module causes the pump to stop operating when the difference between the hydraulic pressure sensed by the first pressure sensor and the hydraulic pressure sensed by the second pressure sensor is below the predetermined value.

13. The marine outboard engine of claim 8, wherein:

the hydraulic actuator is a first hydraulic actuator;

the pump is adapted to receive hydraulic fluid from a second hydraulic actuator, the second hydraulic actuator being driven by a helm of the watercraft;

the pump supplies the hydraulic fluid received from the second hydraulic actuator to the first hydraulic actuator; and the valve unit includes a bypass valve, the valve unit causing hydraulic fluid received from the second hydraulic actuator to bypass the pump when a pressure of the hydraulic fluid received from the second hydraulic actuator is below a predetermined pressure.

14. The marine outboard engine of claim 1, wherein the pump includes a shaft, the shaft being rotatable about a pump axis, the pump axis being generally parallel to the tilt/trim axis and generally perpendicular to the steering axis.

15. The marine outboard engine of claim 1, further comprising a plurality of passages fluidly connecting the pump to the hydraulic actuator, at least a portion of the plurality of passages being integrally formed in the swivel bracket.

16. The marine outboard engine of claim 1, wherein the pump is disposed between the tilt/trim axis and a lower end of the swivel bracket.

17. The marine outboard engine of claim 1, further comprising:

an upper drive unit mounting bracket connecting the drive unit to a first end of the hydraulic actuator; and a lower drive unit mounting bracket connecting the drive unit to a second end of the hydraulic actuator; and wherein the pump is disposed between the upper and lower drive unit mounting brackets.

18. The marine outboard engine of claim 1, wherein:

the hydraulic actuator is a first hydraulic actuator;

the pump is adapted to receive hydraulic fluid from a second hydraulic actuator, the second hydraulic actuator being driven by a helm of the watercraft; and the pump supplies the hydraulic fluid received from the second hydraulic actuator to the first hydraulic actuator.

19. The marine outboard engine of claim 1, wherein the stern bracket defines a space between a left portion of the stern bracket and a right portion of the stern bracket; and wherein the pump is received at least in part in the space when the swivel bracket is in an upright position.

* * * * *